US009520136B2

(12) United States Patent
Sung et al.

(10) Patent No.: US 9,520,136 B2
(45) **Date of Patent: *Dec. 13, 2016**

(54) FRAME ERROR CONCEALMENT METHOD AND APPARATUS, AND AUDIO DECODING METHOD AND APPARATUS

(71) Applicant: SAMSUNG ELECTRONICS CO., LTD., Suwon-si (KR)

(72) Inventors: Ho-sang Sung, Yongin-si (KR); Nam-suk Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/061,590

(22) Filed: Mar. 4, 2016

(65) Prior Publication Data

US 2016/0189719 A1 Jun. 30, 2016

Related U.S. Application Data

(63) Continuation of application No. 14/035,026, filed on Sep. 24, 2013, now Pat. No. 9,280,975.

(60) Provisional application No. 61/704,739, filed on Sep. 24, 2012.

(51) Int. Cl.
*G10L 19/005* (2013.01)

(52) U.S. Cl.
CPC ..... *G10L 19/005* (2013.01)

(58) Field of Classification Search
USPC ..... 704/500
See application file for complete search history.

(56) References Cited

U.S. PATENT DOCUMENTS

| | | | |
|---|---|---|---|
| 5,729,556 | A | 3/1998 | Benbassat et al. |
| 7,962,835 | B2 | 6/2011 | Sung et al. |
| 8,041,212 | B2 | 10/2011 | Gottwald |
| 8,457,115 | B2 | 6/2013 | Zhan et al. |
| 8,712,765 | B2 | 4/2014 | Ehara |
| 2002/0007273 | A1 | 1/2002 | Chen |
| 2005/0240402 | A1 | 10/2005 | Kapilow |
| 2006/0184861 | A1 | 8/2006 | Sun et al. |
| 2006/0265216 | A1 | 11/2006 | Chen |

(Continued)

FOREIGN PATENT DOCUMENTS

| | | | |
|---|---|---|---|
| CN | 101583995 | A | 11/2009 |
| EP | 2 092 755 | A1 | 8/2009 |

(Continued)

OTHER PUBLICATIONS

Communication dated Jan. 12, 2016, issued by the Japanese Patent Office in Japanese Application No. 2015-515953.

(Continued)

*Primary Examiner* — Charlotte M Baker
(74) *Attorney, Agent, or Firm* — Sughrue Mion, PLLC

(57) ABSTRACT

Disclosed are a frame error concealment method and apparatus and an audio decoding method and apparatus. The frame error concealment (FEC) method includes: selecting an FEC mode based on at least one of a state of at least one frame and a phase matching flag, with regard to a time domain signal generated after time-frequency inverse transform processing; and performing corresponding time domain error concealment processing on the current frame based on the selected FEC mode, wherein the current frame is an error frame or the current frame is a normal frame when the previous frame is an error frame.

10 Claims, 40 Drawing Sheets

(56) References Cited

U.S. PATENT DOCUMENTS

| | | | |
|---|---|---|---|
| 2007/0027683 | A1 | 2/2007 | Sung et al. |
| 2007/0094009 | A1 | 4/2007 | Ryu et al. |
| 2007/0118369 | A1 | 5/2007 | Chen |
| 2007/0271480 | A1 | 11/2007 | Oh et al. |
| 2008/0033718 | A1 | 2/2008 | Zopf et al. |
| 2008/0126904 | A1 | 5/2008 | Sung et al. |
| 2008/0133242 | A1 | 6/2008 | Sung et al. |
| 2008/0294428 | A1 | 11/2008 | Raifel et al. |
| 2010/0057447 | A1 | 3/2010 | Ehara |
| 2011/0099008 | A1 | 4/2011 | Zopf |

FOREIGN PATENT DOCUMENTS

| | | | |
|---|---|---|---|
| EP | 2088588 | A1 | 8/2009 |
| JP | 2008-111991 | A | 5/2008 |
| JP | 2012-256070 | A | 12/2012 |
| KR | 10-2006-0124371 | A | 12/2006 |
| KR | 10-2007-0091512 | A | 9/2007 |
| KR | 10-2008-0070026 | A | 7/2008 |
| KR | 10-2008-0075050 | A | 8/2008 |
| KR | 10-0862662 | B1 | 10/2008 |
| KR | 10-2009-0076964 | A | 7/2009 |
| KR | 10-2011-0002070 | A | 1/2011 |
| WO | 2008/056775 | A1 | 5/2008 |
| WO | 2008062959 | A1 | 5/2008 |

OTHER PUBLICATIONS

Communication dated Aug. 25, 2015, issued by the Taiwanese Patent Office in counterpart Taiwanese Application No. 102134458.

Search Report, dated Oct. 16, 2013, issued by the International Searching Authority, in counterpart Application No. PCT/KR2013/005095.

Written Opinion, dated Oct. 16, 2013, issued by the International Searching Authority, in counterpart Application No. PCT/KR/2013/005095.

Search Report, dated Dec. 24, 2013, issued by the Interational Searching Authority, in counterpart Application No. PCT/KR2013/008552.

Written Opinion, dated Dec. 24, 2013, issued by the Interational Searching Authority, in counterpart Application No. PCT/KR2013/008552.

"Low-complexity, full-band audio coding for high-quality, conversational applications", Series G: Transmission Systems and Media, Digital Systems and Networks, ITU-T G.719, 58 pages, Jun. 2008.

Communication dated Aug. 8, 2016 issued by Taiwanese Intellectual Property Office in counterpart Taiwanese Patent Application No. 102120847.

Communication dated Aug. 9, 2016 issued by Taiwanese Intellectual Property Office in counterpart Taiwanese Patent Application No. 102120847.

Communication dated Jul. 14, 2016 issued by European Patent Office in counterpart European Patent Application No. 13800914.7.

R. A. Valenzuela et al., "A New Voice-Packet Reconstruction Technique", D10.5, At&T Bell Laboratories, May 1989, pp. 1334-1336, XP010082522.

David J. Goodman et al., "Waveform Substitution Techniques for Recovering Missing Speech Segments in Packet Voice Communications", Waveform Substitution Techniques, IEEE Transactions on Acoustics, Speech, and Signal Processing, vol. ASSP-34, No. 6, December 1986, pp. 1440-1448, XP-002973610.

Communication dated Oct. 19, 2016, issued by the European Patent Office in counterpart European Application No. 13839397.0.

FRAME ERROR CONCEALMENT METHOD AND APPARATUS, AND AUDIO DECODING METHOD AND APPARATUS

CROSS-REFERENCE TO RELATED PATENT APPLICATION

This application is a continuation application of U.S. patent application Ser. No. 14/035,026, filed on Sep. 24, 2013, which claims the benefit of U.S. Provisional Application No. 61/704,739, filed on Sep. 24, 2012, in the United States Patent and Trademark Office, the disclosure of which is incorporated herein by reference in its entireties.

BACKGROUND

1. Field

Exemplary Embodiments relate to frame error concealment, and more particularly, to a frame error concealment method and apparatus and an audio decoding method and apparatus capable of minimizing deterioration of reconstructed sound quality when an error occurs in partial frames of a decoded audio signal in audio encoding and decoding using time-frequency transform processing.

2. Description of the Related Art

When an encoded audio signal is transmitted over a wired/wireless network, if partial packets are damaged or distorted due to a transmission error, an error may occur in partial frames of a decoded audio signal. If the error is not properly corrected, sound quality of the decoded audio signal may be degraded in a duration including a frame in which the error has occurred (hereinafter, referred to as "error frame") and an adjacent frame.

Regarding audio signal encoding, it is known that a method of performing time-frequency transform processing on a specific signal and then performing a compression process in a frequency domain provides good reconstructed sound quality. In the time-frequency transform processing, a modified discrete cosine transform (MDCT) is widely used. In this case, for audio signal decoding, the frequency domain signal is transformed to a time domain signal using inverse MDCT (IMDCT), and overlap and add (OLA) processing may be performed for the time domain signal. In the OLA processing, if an error occurs in a current frame, a next frame may also be influenced. In particular, a final time domain signal is generated by adding an aliasing component between a previous frame and a subsequent frame to an overlapping part in the time domain signal, and if an error occurs, an accurate aliasing component does not exist, and thus, noise may occur, thereby resulting in considerable deterioration of reconstructed sound quality.

When an audio signal is encoded and decoded using the time-frequency transform processing, in a regression analysis method for obtaining a parameter of an error frame by regression-analyzing a parameter of a previous good frame (PGF) from among methods for concealing a frame error, concealment is possible by somewhat considering original energy for the error frame, but an error concealment efficiency may be degraded in a portion where a signal is gradually increasing or is severely fluctuated. In addition, the regression analysis method tends to cause an increase in complexity when the number of types of parameters to be applied increases. In a repetition method for restoring a signal in an error frame by repeatedly reproducing a PGF of the error frame, it may be difficult to minimize deterioration of reconstructed sound quality due to a characteristic of the OLA processing. An interpolation method for predicting a parameter of an error frame by interpolating parameters of a PGF and a next good frame (NGF) needs an additional delay of one frame, and thus, it is not proper to employ the interpolation method in a communication codec sensitive to a delay.

Thus, when an audio signal is encoded and decoded using the time-frequency transform processing, there is a need of a method for concealing a frame error without an additional time delay or an excessive increase in complexity to minimize deterioration of reconstructed sound quality due to the frame error.

SUMMARY

Exemplary Embodiments provide a frame error concealment method and apparatus for concealing a frame error with low complexity without an additional time delay when an audio signal is encoded and decoded using the time-frequency transform processing.

Exemplary Embodiments also provide an audio decoding method and apparatus for minimizing deterioration of reconstructed sound quality due to a frame error when an audio signal is encoded and decoded using the time-frequency transform processing.

Exemplary Embodiments also provide an audio encoding method and apparatus for more accurately detecting information on a transient frame used for frame error concealment in an audio decoding apparatus.

Exemplary Embodiments also provide a non-transitory computer-readable storage medium having stored therein program instructions, which when executed by a computer, perform the frame error concealment method, the audio encoding method, or the audio decoding method.

Exemplary Embodiments also provide a multimedia device employing the frame error concealment apparatus, the audio encoding apparatus, or the audio decoding apparatus According to an aspect of an exemplary embodiment, there is provided a frame error concealment (FEC) method including: selecting one FEC mode from among a first main mode using phase matching and a second main mode using simple repetition, based on at least one of a state of a frame and a phase matching flag, with regard to a time domain signal generated after time-frequency inverse transform processing; and performing corresponding time domain error concealment processing on the current frame based on the selected FEC mode, wherein the current frame is an error frame or the current frame is a normal frame when the previous frame is an error frame.

According to another aspect of an exemplary embodiment, there is provided an audio decoding method including: performing error concealment processing in a frequency domain when a current frame is an error frame; decoding spectral coefficients when the current frame is a normal frame; performing time-frequency inverse transform processing on the current frame that is an error frame or a normal frame; and selecting one FEC mode from among a first main mode using phase matching and a second main mode using simple repetition, based on at least one of a state of at least one frame and a phase matching flag, with regard to a time domain signal generated after time-frequency inverse transform processing; and performing corresponding time domain error concealment processing on the current frame based on the selected FEC mode, wherein the current frame is an error frame or the current frame is a normal frame when the previous frame is an error frame.

In audio encoding and decoding using time-frequency transform processing, when an error occurs in partial frames in a decoded audio signal, by performing smoothing processing in an optimal method according to a signal characteristic in the time domain, a rapid signal fluctuation due to an error frame in the decoded audio signal may be smoothed with low complexity without an additional delay.

In particular, an error frame that is a transient frame or an error frame constituting a burst error may be more accurately reconstructed, and as a result, influence affected to a normal frame next to the error frame may be minimized.

In addition, by copying a predetermined sized segment obtained using phase matching from a plurality of previous frames stored in a buffer to a current frame that is an error frame and performing smoothing processing between adjacent frames, the improvement of reconstructed sound quality for a low frequency band may be additionally expected.

BRIEF DESCRIPTION OF THE DRAWINGS

The above and other features and advantages will become more apparent by describing in detail exemplary embodiments thereof with reference to the attached drawings in which.

DETAILED DESCRIPTION

The present inventive concept may allow various kinds of change or modification and various changes in form, and specific exemplary embodiments will be illustrated in drawings and described in detail in the specification. However, it should be understood that the specific exemplary embodiments do not limit the present inventive concept to a specific disclosing form but include every modified, equivalent, or replaced one within the spirit and technical scope of the present inventive concept. In the following description, well-known functions or constructions are not described in detail since they would obscure the invention with unnecessary detail.

Although terms, such as 'first' and 'second', can be used to describe various elements, the elements cannot be limited by the terms. The terms can be used to classify a certain element from another element.

The terminology used in the application is used only to describe specific exemplary embodiments and does not have any intention to limit the present inventive concept. Although general terms as currently widely used as possible are selected as the terms used in the present inventive concept while taking functions in the present inventive concept into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the invention. Accordingly, the terms used in the present inventive concept should be defined not by simple names of the terms but by the meaning of the terms and the content over the present inventive concept.

An expression in the singular includes an expression in the plural unless they are clearly different from each other in a context. In the application, it should be understood that terms, such as 'include' and 'have', are used to indicate the existence of implemented feature, number, step, operation, element, part, or a combination of them without excluding in advance the possibility of existence or addition of one or more other features, numbers, steps, operations, elements, parts, or combinations of them.

Exemplary embodiments will now be described in detail with reference to the accompanying drawings.

Figure 1A:
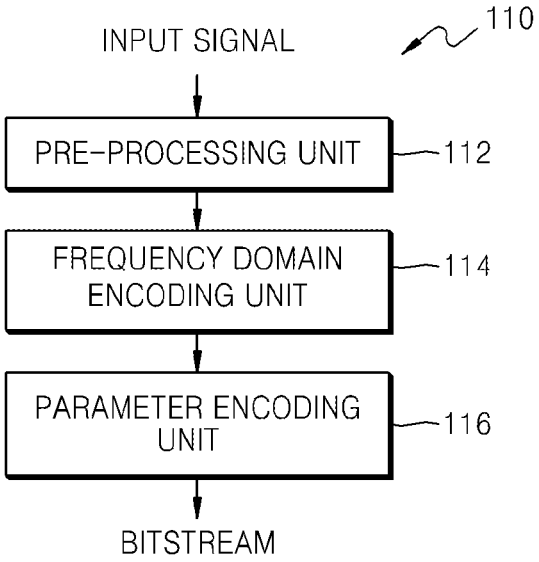
FIGS. 1A and 1B are block diagrams of an audio encoding apparatus and an audio decoding apparatus according to an exemplary embodiment, respectively.
Figure 1B:
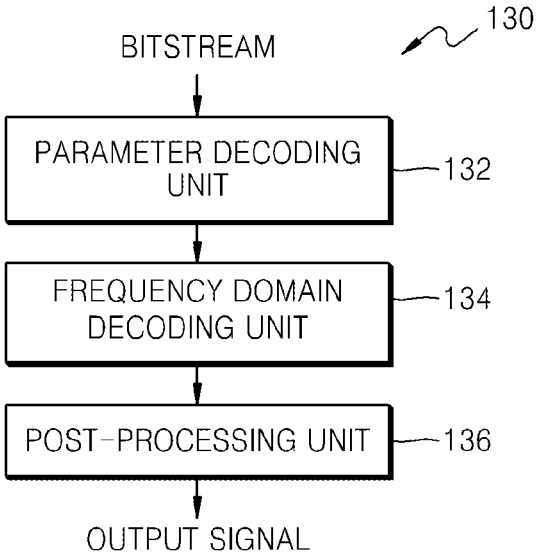

FIGS. 1A and 1B are block diagrams of an audio encoding apparatus 110 and an audio decoding apparatus 130 according to an exemplary embodiment, respectively.

The audio encoding apparatus 110 shown in FIG. 1A may include a pre-processing unit 112, a frequency domain encoding unit 114, and a parameter encoding unit 116. The components may be integrated in at least one module and may be implemented as at least one processor (not shown).

In FIG. 1A, the pre-processing unit 112 may perform filtering, down-sampling, or the like for an input signal, but is not limited thereto. The input signal may include a speech signal, a music signal, or a mixed signal of speech and music. Hereinafter, for convenience of description, the input signal is referred to as an audio signal.

The frequency domain encoding unit 114 may perform a time-frequency transform on the audio signal provided by the pre-processing unit 112, select a coding tool in correspondence with the number of channels, a coding band, and a bit rate of the audio signal, and encode the audio signal by using the selected coding tool. The time-frequency transform uses a modified discrete cosine transform (MDCT), a modulated lapped transform (MLT), or a fast Fourier transform (FFT), but is not limited thereto. When the number of given bits is sufficient, a general transform coding scheme may be applied to the whole bands, and when the number of given bits is not sufficient, a bandwidth extension scheme may be applied to partial bands. When the audio signal is a stereo-channel or multi-channel, if the number of given bits is sufficient, encoding is performed for each channel, and if the number of given bits is not sufficient, a down-mixing scheme may be applied. An encoded spectral coefficient is generated by the frequency domain encoding unit 114.

The parameter encoding unit 116 may extract a parameter from the encoded spectral coefficient provided from the frequency domain encoding unit 114 and encode the extracted parameter. The parameter may be extracted, for example, for each sub-band, which is a unit of grouping spectral coefficients, and may have a uniform or non-uniform length by reflecting a critical band. When each sub-band has a non-uniform length, a sub-band existing in a low frequency band may have a relatively short length compared with a sub-band existing in a high frequency band. The number and a length of sub-bands included in one frame vary according to codec algorithms and may affect the encoding performance. The parameter may include, for example a scale factor, power, average energy, or Norm, but is not limited thereto. Spectral coefficients and parameters obtained as an encoding result form a bitstream, and the bitstream may be stored in a storage medium or may be transmitted in a form of, for example, packets through a channel.

The audio decoding apparatus 130 shown in FIG. 1B may include a parameter decoding unit 132, a frequency domain decoding unit 134, and a post-processing unit 136. The frequency domain decoding unit 134 may include a frame error concealment algorithm. The components may be integrated in at least one module and may be implemented as at least one processor (not shown).

In FIG. 1B, the parameter decoding unit 132 may decode parameters from a received bitstream and check whether an error has occurred in frame units from the decoded parameters. Various well-known methods may be used for the error check, and information on whether a current frame is a normal frame or an error frame is provided to the frequency domain decoding unit 134.

When the current frame is a normal frame, the frequency domain decoding unit 134 may generate synthesized spectral coefficients by performing decoding through a general transform decoding process. When the current frame is an error frame, the frequency domain decoding unit 134 may generate synthesized spectral coefficients by scaling spectral coefficients of a previous good frame (PGF) through an error concealment algorithm. The frequency domain decoding unit 134 may generate a time domain signal by performing a frequency-time transform on the synthesized spectral coefficients.

The post-processing unit 136 may perform filtering, up-sampling, or the like for sound quality improvement with respect to the time domain signal provided from the frequency domain decoding unit 134, but is not limited thereto. The post-processing unit 136 provides a reconstructed audio signal as an output signal.

Figure 2A:
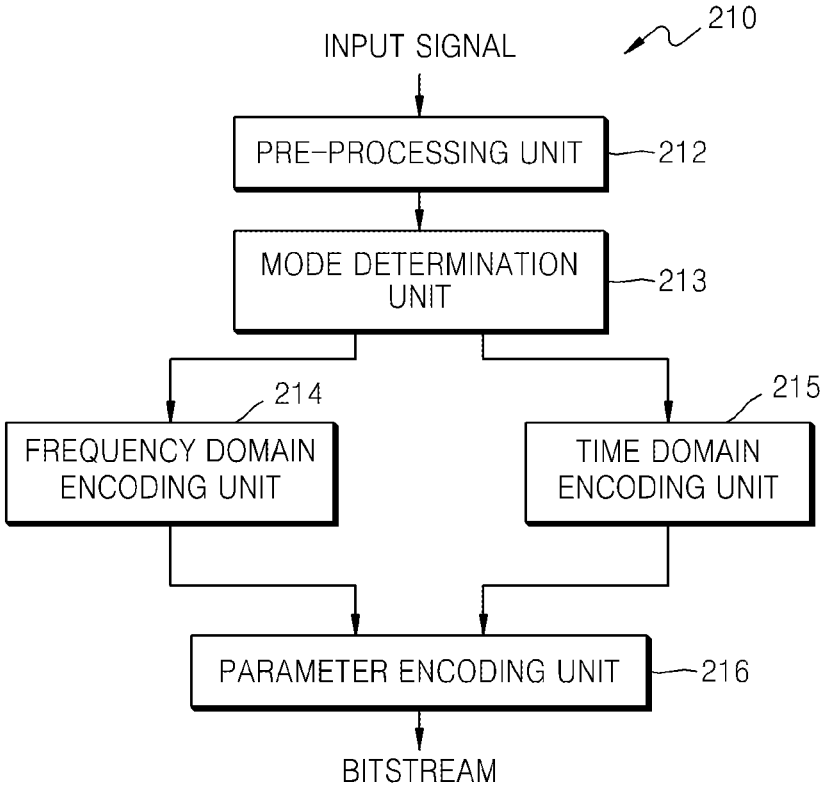
FIGS. 2A and 2B are block diagrams of an audio encoding apparatus and an audio decoding apparatus according to another exemplary embodiment, respectively.
Figure 2B:
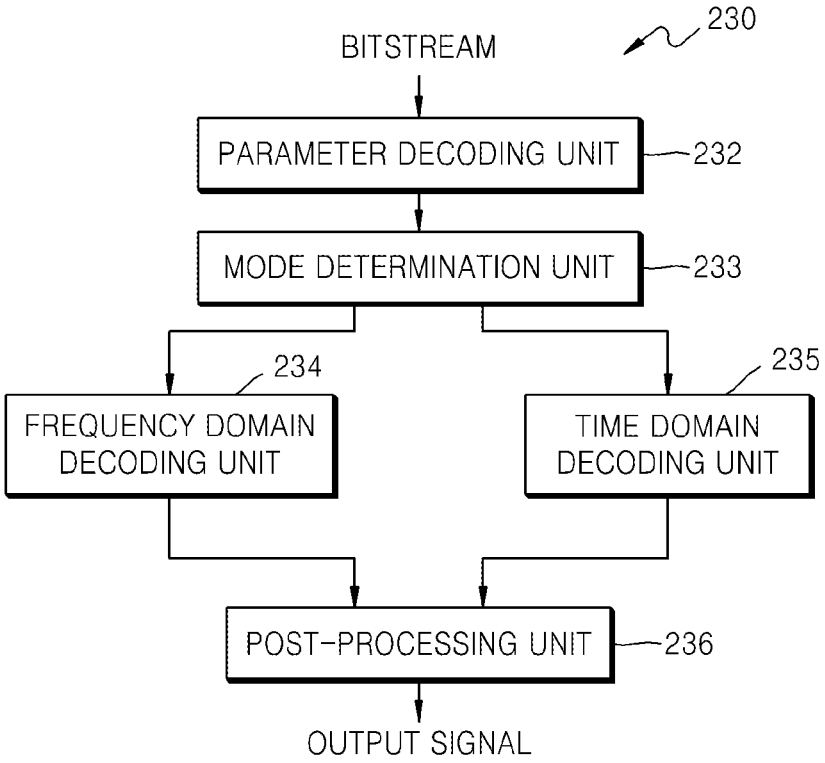

FIGS. 2A and 2B are block diagrams of an audio encoding apparatus 210 and an audio decoding apparatus 230, according to another exemplary embodiment, respectively, which have a switching structure.

The audio encoding apparatus 210 shown in FIG. 2A may include a pre-processing unit 212, a mode determination unit 213, a frequency domain encoding unit 214, a time domain encoding unit 215, and a parameter encoding unit 216. The components may be integrated in at least one module and may be implemented as at least one processor (not shown).

In FIG. 2A, since the pre-processing unit 212 is substantially the same as the pre-processing unit 112 of FIG. 1A, the description thereof is not repeated.

The mode determination unit 213 may determine a coding mode by referring to a characteristic of an input signal. The mode determination unit 213 may determine according to the characteristic of the input signal whether a coding mode suitable for a current frame is a speech mode or a music mode and may also determine whether a coding mode efficient for the current frame is a time domain mode or a frequency domain mode. The characteristic of the input signal may be perceived by using a short-term characteristic of a frame or a long-term characteristic of a plurality of frames, but is not limited thereto. For example, if the input signal corresponds to a speech signal, the coding mode may be determined as the speech mode or the time domain mode, and if the input signal corresponds to a signal other than a speech signal, i.e., a music signal or a mixed signal, the coding mode may be determined as the music mode or the frequency domain mode. The mode determination unit 213 may provide an output signal of the pre-processing unit 212 to the frequency domain encoding unit 214 when the characteristic of the input signal corresponds to the music mode or the frequency domain mode and may provide an output signal of the pre-processing unit 212 to the time domain encoding unit 215 when the characteristic of the input signal corresponds to the speech mode or the time domain mode.

Since the frequency domain encoding unit 214 is substantially the same as the frequency domain encoding unit 114 of FIG. 1A, the description thereof is not repeated.

The time domain encoding unit 215 may perform code excited linear prediction (CELP) coding for an audio signal provided from the pre-processing unit 212. In detail, algebraic CELP may be used for the CELP coding, but the CELP coding is not limited thereto. An encoded spectral coefficient is generated by the time domain encoding unit 215.

The parameter encoding unit 216 may extract a parameter from the encoded spectral coefficient provided from the frequency domain encoding unit 214 or the time domain encoding unit 215 and encodes the extracted parameter. Since the parameter encoding unit 216 is substantially the same as the parameter encoding unit 116 of FIG. 1A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 230 shown in FIG. 2B may include a parameter decoding unit 232, a mode determination unit 233, a frequency domain decoding unit 234, a time domain decoding unit 235, and a post-processing unit 236. Each of the frequency domain decoding unit 234 and the time domain decoding unit 235 may include a frame error concealment algorithm in each corresponding domain. The components may be integrated in at least one module and may be implemented as at least one processor (not shown).

In FIG. 2B, the parameter decoding unit 232 may decode parameters from a bitstream transmitted in a form of packets and check whether an error has occurred in frame units from the decoded parameters. Various well-known methods may be used for the error check, and information on whether a current frame is a normal frame or an error frame is provided to the frequency domain decoding unit 234 or the time domain decoding unit 235.

The mode determination unit 233 may check coding mode information included in the bitstream and provide a current frame to the frequency domain decoding unit 234 or the time domain decoding unit 235.

The frequency domain decoding unit 234 may operate when a coding mode is the music mode or the frequency domain mode and generate synthesized spectral coefficients by performing decoding through a general transform decoding process when the current frame is a normal frame. When the current frame is an error frame, and a coding mode of a previous frame is the music mode or the frequency domain mode, the frequency domain decoding unit 234 may generate synthesized spectral coefficients by scaling spectral coefficients of a PGF through a frame error concealment algorithm. The frequency domain decoding unit 234 may generate a time domain signal by performing a frequency-time transform on the synthesized spectral coefficients.

The time domain decoding unit 235 may operate when the coding mode is the speech mode or the time domain mode and generate a time domain signal by performing decoding through a general CELP decoding process when the current frame is a normal frame. When the current frame is an error frame, and the coding mode of the previous frame is the speech mode or the time domain mode, the time domain decoding unit 235 may perform a frame error concealment algorithm in the time domain.

The post-processing unit 236 may perform filtering, up-sampling, or the like for the time domain signal provided from the frequency domain decoding unit 234 or the time domain decoding unit 235, but is not limited thereto. The post-processing unit 236 provides a reconstructed audio signal as an output signal.

Figure 3A:
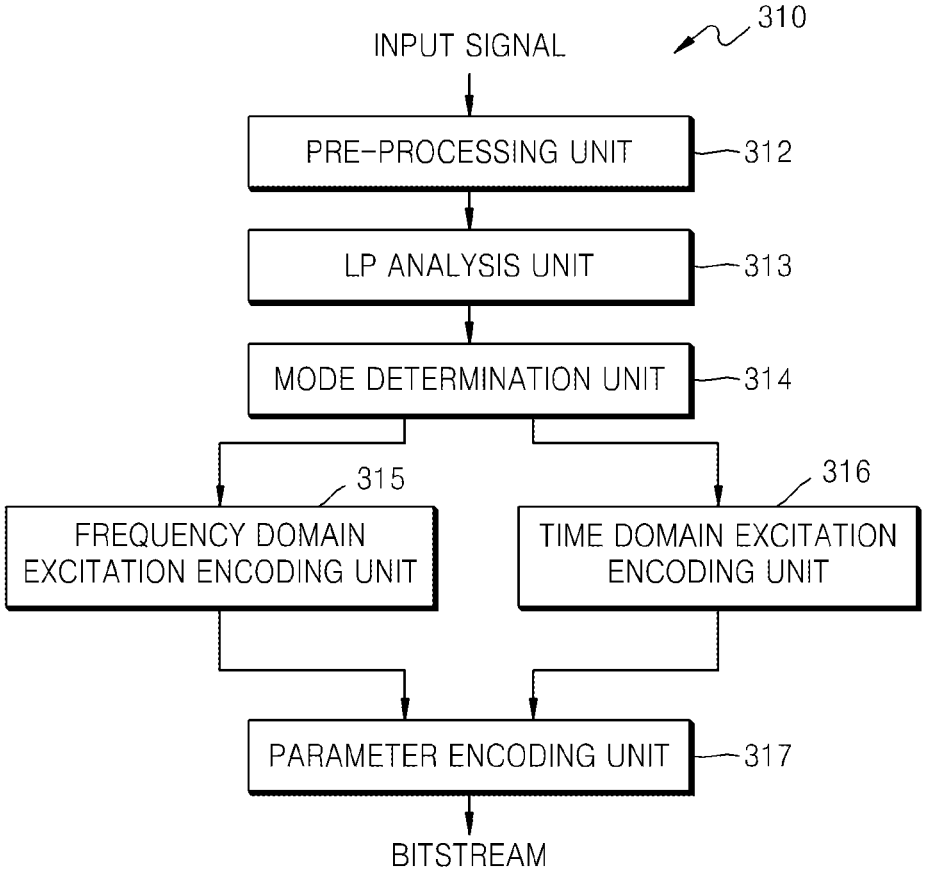
FIGS. 3A and 3B are block diagrams of an audio encoding apparatus and an audio decoding apparatus according to another exemplary embodiment, respectively.
Figure 3B:
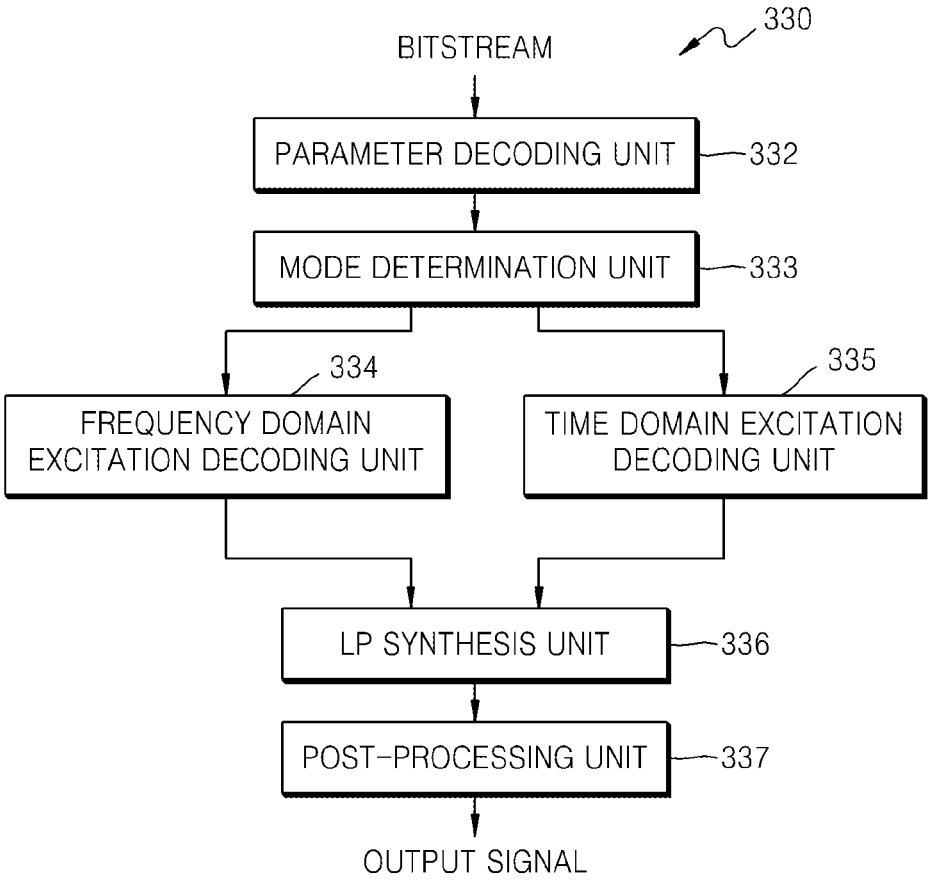

FIGS. 3A and 3B are block diagrams of an audio encoding apparatus 310 and an audio decoding apparatus 320 according to another exemplary embodiment, respectively.

The audio encoding apparatus 310 shown in FIG. 3A may include a pre-processing unit 312, a linear prediction (LP) analysis unit 313, a mode determination unit 314, a frequency domain excitation encoding unit 315, a time domain excitation encoding unit 316, and a parameter encoding unit 317. The components may be integrated in at least one module and may be implemented as at least one processor (not shown).

In FIG. 3A, since the pre-processing unit 312 is substantially the same as the pre-processing unit 112 of FIG. 1A, the description thereof is not repeated.

The LP analysis unit 313 may extract LP coefficients by performing LP analysis for an input signal and generate an excitation signal from the extracted LP coefficients. The excitation signal may be provided to one of the frequency domain excitation encoding unit 315 and the time domain excitation encoding unit 316 according to a coding mode.

Since the mode determination unit 314 is substantially the same as the mode determination unit 213 of FIG. 2A, the description thereof is not repeated.

The frequency domain excitation encoding unit 315 may operate when the coding mode is the music mode or the frequency domain mode, and since the frequency domain excitation encoding unit 315 is substantially the same as the frequency domain encoding unit 114 of FIG. 1A except that an input signal is an excitation signal, the description thereof is not repeated.

The time domain excitation encoding unit 316 may operate when the coding mode is the speech mode or the time domain mode, and since the time domain excitation encoding unit 316 is substantially the same as the time domain encoding unit 215 of FIG. 2A, the description thereof is not repeated.

The parameter encoding unit 317 may extract a parameter from an encoded spectral coefficient provided from the frequency domain excitation encoding unit 315 or the time domain excitation encoding unit 316 and encode the extracted parameter. Since the parameter encoding unit 317 is substantially the same as the parameter encoding unit 116 of FIG. 1A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 330 shown in FIG. 3B may include a parameter decoding unit 332, a mode determination unit 333, a frequency domain excitation decoding unit 334, a time domain excitation decoding unit 335, an LP synthesis unit 336, and a post-processing unit 337. Each of the frequency domain excitation decoding unit 334 and the time domain excitation decoding unit 335 may include a frame error concealment algorithm in each corresponding domain. The components may be integrated in at least one module and may be implemented as at least one processor (not shown).

In FIG. 3B, the parameter decoding unit 332 may decode parameters from a bitstream transmitted in a form of packets and check whether an error has occurred in frame units from the decoded parameters. Various well-known methods may be used for the error check, and information on whether a current frame is a normal frame or an error frame is provided to the frequency domain excitation decoding unit 334 or the time domain excitation decoding unit 335.

The mode determination unit 333 may check coding mode information included in the bitstream and provide a current frame to the frequency domain excitation decoding unit 334 or the time domain excitation decoding unit 335.

The frequency domain excitation decoding unit 334 may operate when a coding mode is the music mode or the frequency domain mode and generate synthesized spectral coefficients by performing decoding through a general transform decoding process when the current frame is a normal frame. When the current frame is an error frame, and a coding mode of a previous frame is the music mode or the frequency domain mode, the frequency domain excitation decoding unit 334 may generate synthesized spectral coefficients by scaling spectral coefficients of a PGF through a frame error concealment algorithm. The frequency domain excitation decoding unit 334 may generate an excitation signal that is a time domain signal by performing a frequency-time transform on the synthesized spectral coefficients.

The time domain excitation decoding unit 335 may operate when the coding mode is the speech mode or the time domain mode and generate an excitation signal that is a time domain signal by performing decoding through a general CELP decoding process when the current frame is a normal frame. When the current frame is an error frame, and the coding mode of the previous frame is the speech mode or the time domain mode, the time domain excitation decoding unit 335 may perform a frame error concealment algorithm in the time domain.

The LP synthesis unit 336 may generate a time domain signal by performing LP synthesis for the excitation signal provided from the frequency domain excitation decoding unit 334 or the time domain excitation decoding unit 335.

The post-processing unit 337 may perform filtering, upsampling, or the like for the time domain signal provided from the LP synthesis unit 336, but is not limited thereto. The post-processing unit 337 provides a reconstructed audio signal as an output signal.

Figure 4A:
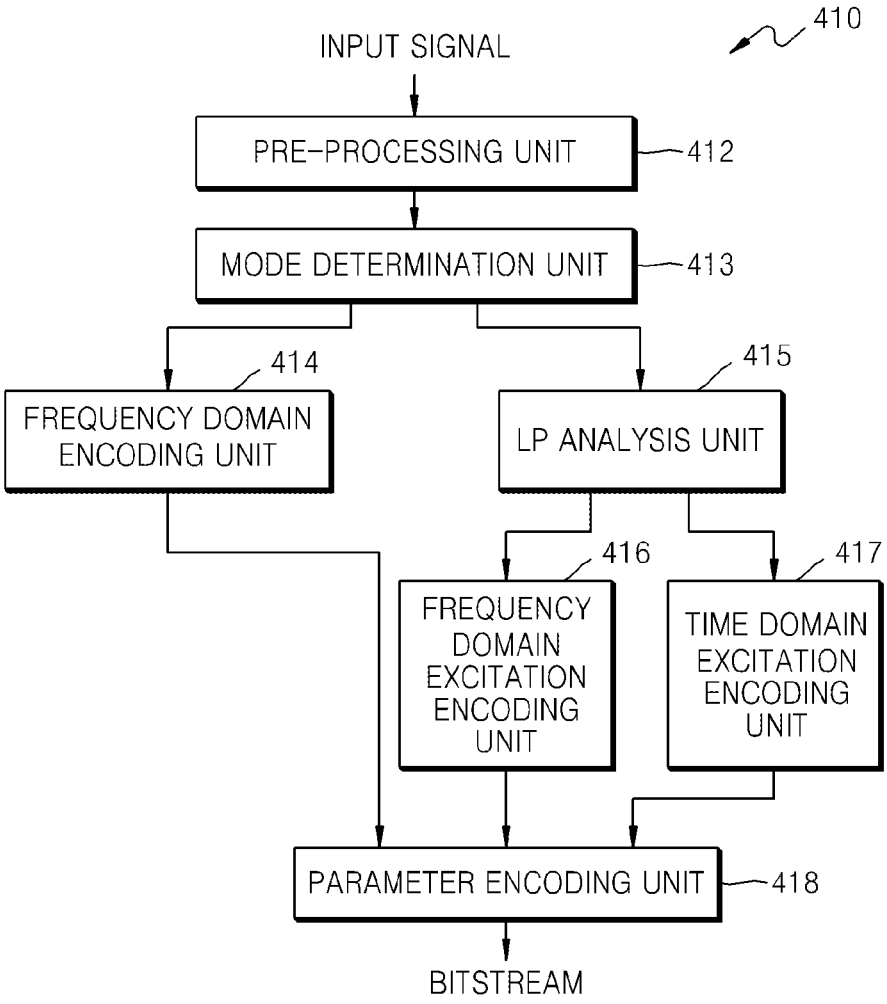
FIGS. 4A and 4B are block diagrams of an audio encoding apparatus and an audio decoding apparatus according to another exemplary embodiment, respectively.
Figure 4B:
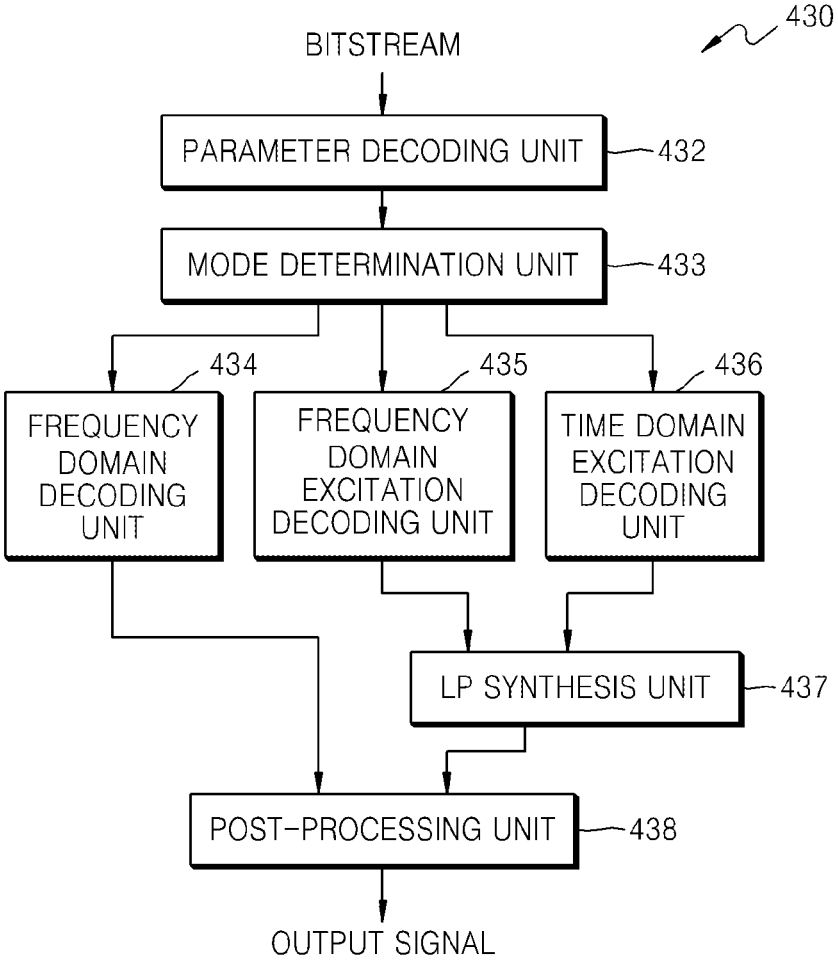

FIGS. 4A and 4B are block diagrams of an audio encoding apparatus 410 and an audio decoding apparatus 430 according to another exemplary embodiment, respectively, which have a switching structure.

The audio encoding apparatus 410 shown in FIG. 4A may include a pre-processing unit 412, a mode determination unit 413, a frequency domain encoding unit 414, an LP analysis unit 415, a frequency domain excitation encoding unit 416, a time domain excitation encoding unit 417, and a parameter encoding unit 418. The components may be integrated in at least one module and may be implemented as at least one processor (not shown). Since it can be considered that the audio encoding apparatus 410 shown in FIG. 4A is obtained by combining the audio encoding apparatus 210 of FIG. 2A and the audio encoding apparatus 310 of FIG. 3A, the description of operations of common parts is not repeated, and an operation of the mode determination unit 413 will now be described.

The mode determination unit 413 may determine a coding mode of an input signal by referring to a characteristic and a bit rate of the input signal. The mode determination unit 413 may determine the coding mode as a CELP mode or another mode based on whether a current frame is the speech mode or the music mode according to the characteristic of the input signal and based on whether a coding mode efficient for the current frame is the time domain mode or the frequency domain mode. The mode determination unit 413 may determine the coding mode as the CELP mode when the characteristic of the input signal corresponds to the speech mode, determine the coding mode as the frequency domain mode when the characteristic of the input signal corresponds to the music mode and a high bit rate, and determine the coding mode as an audio mode when the characteristic of the input signal corresponds to the music mode and a low bit rate. The mode determination unit 413 may provide the input signal to the frequency domain encoding unit 414 when the coding mode is the frequency domain mode, provide the input signal to the frequency domain excitation encoding unit 416 via the LP analysis unit 415 when the coding mode is the audio mode, and provide the input signal to the time domain excitation encoding unit 417 via the LP analysis unit 415 when the coding mode is the CELP mode.

The frequency domain encoding unit 414 may correspond to the frequency domain encoding unit 114 in the audio encoding apparatus 110 of FIG. 1A or the frequency domain encoding unit 214 in the audio encoding apparatus 210 of FIG. 2A, and the frequency domain excitation encoding unit 416 or the time domain excitation encoding unit 417 may correspond to the frequency domain excitation encoding unit 315 or the time domain excitation encoding unit 316 in the audio encoding apparatus 310 of FIG. 3A.

The audio decoding apparatus 430 shown in FIG. 4B may include a parameter decoding unit 432, a mode determination unit 433, a frequency domain decoding unit 434, a frequency domain excitation decoding unit 435, a time domain excitation decoding unit 436, an LP synthesis unit 437, and a post-processing unit 438. Each of the frequency domain decoding unit 434, the frequency domain excitation decoding unit 435, and the time domain excitation decoding unit 436 may include a frame error concealment algorithm in each corresponding domain. The components may be integrated in at least one module and may be implemented as at least one processor (not shown). Since it can be considered that the audio decoding apparatus 430 shown in FIG. 4B is obtained by combining the audio decoding apparatus 230 of FIG. 2B and the audio decoding apparatus 330 of FIG. 3B, the description of operations of common parts is not repeated, and an operation of the mode determination unit 433 will now be described.

The mode determination unit 433 may check coding mode information included in a bitstream and provide a current frame to the frequency domain decoding unit 434, the frequency domain excitation decoding unit 435, or the time domain excitation decoding unit 436.

The frequency domain decoding unit 434 may correspond to the frequency domain decoding unit 134 in the audio decoding apparatus 130 of FIG. 1B or the frequency domain decoding unit 234 in the audio encoding apparatus 230 of FIG. 2B, and the frequency domain excitation decoding unit 435 or the time domain excitation decoding unit 436 may correspond to the frequency domain excitation decoding unit 334 or the time domain excitation decoding unit 335 in the audio decoding apparatus 330 of FIG. 3B.

Figure 5:
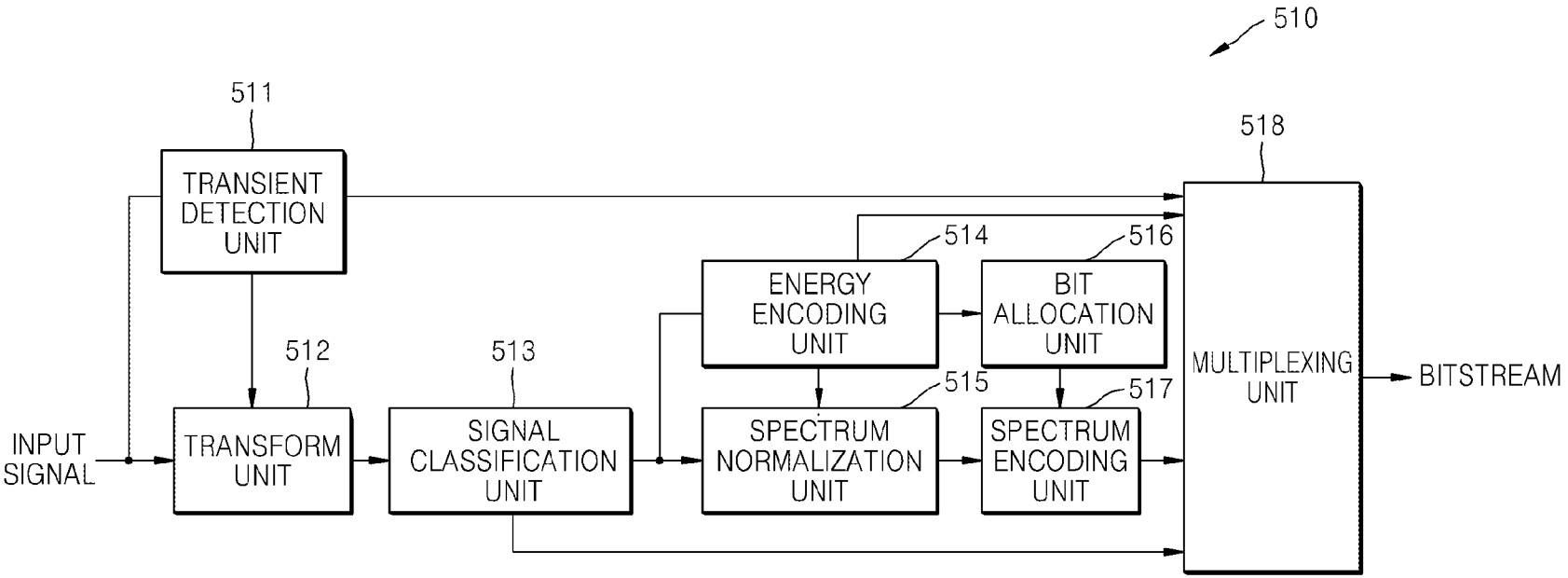
FIG. 5 is a block diagram of a frequency domain audio encoding apparatus according to an exemplary embodiment.

FIG. 5 is a block diagram of a frequency domain audio encoding apparatus 510 according to an exemplary embodiment.

The frequency domain audio encoding apparatus 510 shown in FIG. 5 may include a transient detection unit 511, a transform unit 512, a signal classification unit 513, an energy encoding unit 514, a spectrum normalization unit 515, a bit allocation unit 516, a spectrum encoding unit 517, and a multiplexing unit 518. The components may be integrated in at least one module and may be implemented as at least one processor (not shown). The frequency domain audio encoding apparatus 510 may perform all functions of the frequency domain audio encoding unit 214 and partial functions of the parameter encoding unit 216 shown in FIG. 2. The frequency domain audio encoding apparatus 510 may be replaced by a configuration of an encoder disclosed in the ITU-T G.719 standard except for the signal classification unit 513, and the transform unit 512 may use a transform window having an overlap duration of 50%. In addition, the frequency domain audio encoding apparatus 510 may be replaced by a configuration of an encoder disclosed in the ITU-T G.719 standard except for the transient detection unit 511 and the signal classification unit 513. In each case, although not shown, a noise level estimation unit may be further included at a rear end of the spectrum encoding unit 517 as in the ITU-T G.719 standard to estimate a noise level for a spectral coefficient to which a bit is not allocated in a bit allocation process and insert the estimated noise level into a bitstream.

Referring to FIG. 5, the transient detection unit 511 may detect a duration exhibiting a transient characteristic by analyzing an input signal and generate transient signaling information for each frame in response to a result of the detection. Various well-known methods may be used for the detection of a transient duration. According to an exemplary embodiment, when the transform unit 512 may use a window having an overlap duration less than 50%, the transient detection unit 511 may primarily determine whether a current frame is a transient frame and secondarily verify the current frame that has been determined as a transient frame. The transient signaling information may be included in a bitstream by the multiplexing unit 518 and may be provided to the transform unit 512.

The transform unit 512 may determine a window size to be used for a transform according to a result of the detection of a transient duration and perform a time-frequency transform based on the determined window size. For example, a short window may be applied to a sub-band from which a transient duration has been detected, and a long window may be applied to a sub-band from which a transient duration has not been detected. As another example, a short window may be applied to a frame including a transient duration.

The signal classification unit 513 may analyze a spectrum provided from the transform unit 512 to determine whether each frame corresponds to a harmonic frame. Various well-known methods may be used for the determination of a harmonic frame. According to an exemplary embodiment, the signal classification unit 513 may split the spectrum provided from the transform unit 512 to a plurality of sub-bands and obtain a peak energy value and an average energy value for each sub-band. Thereafter, the signal classification unit 513 may obtain the number of sub-bands of which a peak energy value is greater than an average energy value by a predetermined ratio or above for each frame and determine, as a harmonic frame, a frame in which the obtained number of sub-bands is greater than or equal to a predetermined value. The predetermined ratio and the predetermined value may be determined in advance through experiments or simulations. Harmonic signaling information may be included in the bitstream by the multiplexing unit 518.

The energy encoding unit 514 may obtain energy in each sub-band unit and quantize and lossless-encode the energy. According to an embodiment, a Norm value corresponding to average spectral energy in each sub-band unit may be used as the energy and a scale factor or a power may also be used, but the energy is not limited thereto. The Norm value of each sub-band may be provided to the spectrum normalization unit 515 and the bit allocation unit 516 and may be included in the bitstream by the multiplexing unit 518.

The spectrum normalization unit 515 may normalize the spectrum by using the Norm value obtained in each sub-band unit.

The bit allocation unit 516 may allocate bits in integer units or decimal point units by using the Norm value obtained in each sub-band unit. In addition, the bit allocation unit 516 may calculate a masking threshold by using the Norm value obtained in each sub-band unit and estimate the perceptually required number of bits, i.e., the allowable number of bits, by using the masking threshold. The bit allocation unit 516 may limit that the allocated number of bits does not exceed the allowable number of bits for each sub-band. The bit allocation unit 516 may sequentially allocate bits from a sub-band having a larger Norm value and weigh the Norm value of each sub-band according to perceptual importance of each sub-band to adjust the allocated number of bits so that a more number of bits are allocated to a perceptually important sub-band. The quantized Norm value provided from the energy encoding unit 514 to the bit allocation unit 516 may be used for the bit allocation after being adjusted in advance to consider psychoacoustic weighting and a masking effect as in the ITU-T G.719 standard.

The spectrum encoding unit 517 may quantize the normalized spectrum by using the allocated number of bits of each sub-band and lossless-encode a result of the quantization. For example, factorial pulse coding (FPC) may be used for the spectrum encoding. In addition, a trellis coding may also be used for the spectrum encoding, but the spectrum encoding is not limited thereto. Moreover, a variety of spectrum encoding methods may also be used according to either environments in which a corresponding codec is embodied or a user's need. According to FPC, information, such as a location of a pulse, a magnitude of the pulse, and a sign of the pulse, within the allocated number of bits may be represented in a factorial format. Information on the spectrum encoded by the spectrum encoding unit 517 may be included in the bitstream by the multiplexing unit 518.

Figure 6:
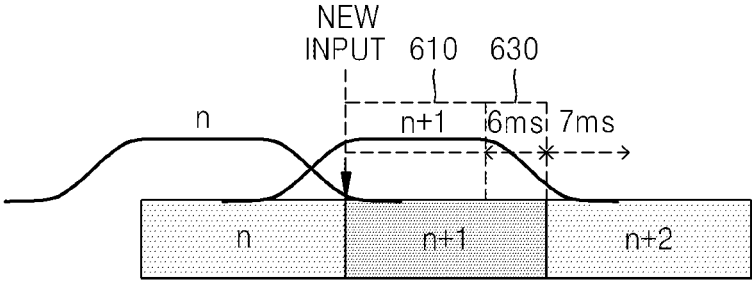
FIG. 6 is a diagram for describing a duration in which a hangover flag is set to 1 when a transform window having an overlap duration less than 50% is used.

FIG. 6 is a diagram for describing a duration in which a hangover flag is required when a window having an overlap duration less than 50% is used.

Referring to FIG. 6, when a duration that is of a current frame n+1 and has been detected to be transient corresponds to a duration 610 in which an overlap is not performed, a window for a transient frame, e.g., a short window, does not have to be used for a next frame n. However, when the duration that is of a current frame n+1 and has been detected to be transient corresponds to the duration 610 in which an overlap occurs, the improvement of reconstructed sound quality for which a signal characteristic has been considered can be expected by using a window for a transient frame with respect to the next frame n. As described above, when a window having an overlap duration less than 50% is used, whether the hangover flag is generated may be determined according to a location at which is detected to be transient in a frame.

Figure 7:
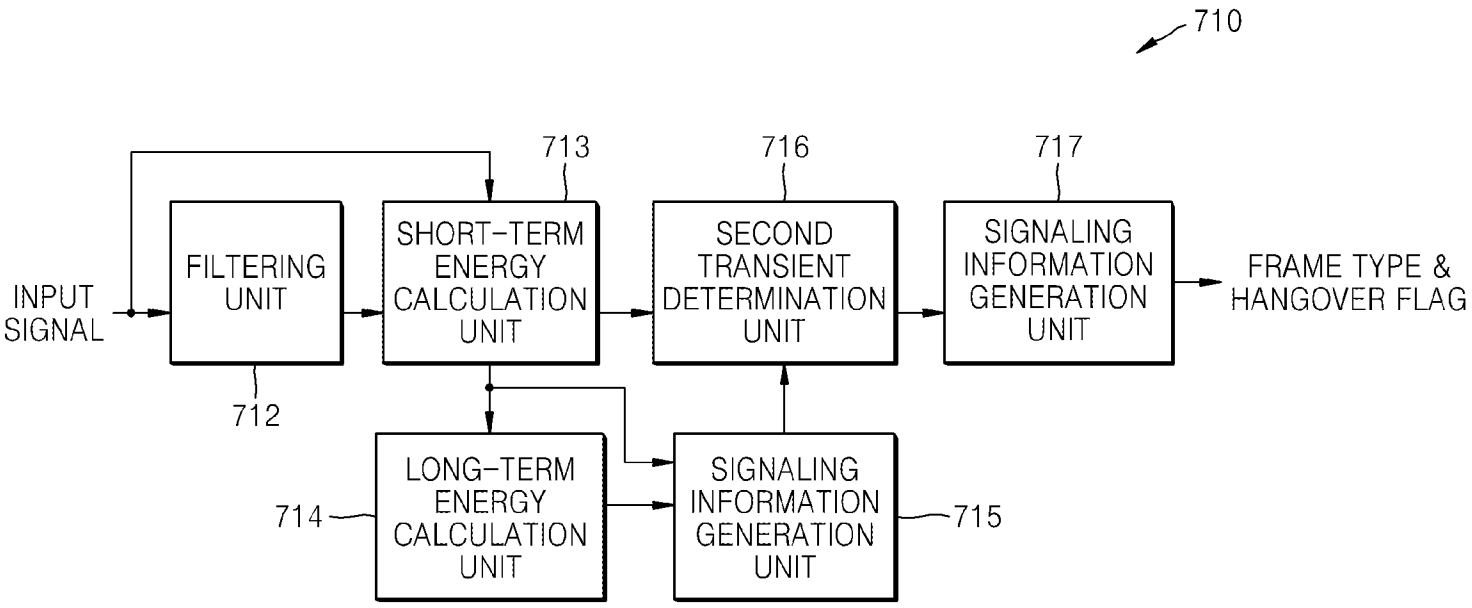
FIG. 7 is a block diagram of a transient detection unit in the frequency domain audio encoding apparatus of FIG. 5, according to an exemplary embodiment.

FIG. 7 is a block diagram of the transient detection unit 511 (referred to as 710 in FIG. 7) shown in FIG. 5, according to an exemplary embodiment.

The transient detection unit 710 shown in FIG. 7 may include a filtering unit 712, a short-term energy calculation unit 713, a long-term energy calculation unit 714, a first transient determination unit 715, a second transient determination unit 716, and a signaling information generation unit 717. The components may be integrated in at least one module and may be implemented as at least one processor (not shown). The transient detection unit 710 may be replaced by a configuration disclosed in the ITU-T G.719 standard except for the short-term energy calculation unit 713, the second transient determination unit 716, and the signaling information generation unit 717.

Referring to FIG. 7, the filtering unit 712 may perform high pass filtering of an input signal sampled at, for example, 48 KHz.

The short-term energy calculation unit 713 may receive a signal filtered by the filtering unit 712, split each frame into, for example, four subframes, i.e., four blocks, and calculate short-term energy of each block. In addition, the short-term energy calculation unit 713 may also calculate short-term energy of each block in frame units for the input signal and provide the calculated short-term energy of each block to the second transient determination unit 716.

The long-term energy calculation unit 714 may calculate long-term energy of each block in frame units.

The first transient determination unit 715 may compare the short-term energy with the long-term energy for each block and determine that a current frame is a transient frame if, in a block of the current frame, the short-term energy is greater than the long-term energy by a predetermined ratio or above.

The second transient determination unit 716 may perform an additional verification process and may determine again whether the current frame that has been determined as a transient frame is a transient frame. This is to prevent a transient determination error which may occur due to the removal of energy in a low frequency band that results from the high pass filtering in the filtering unit 712.

Figure 8:
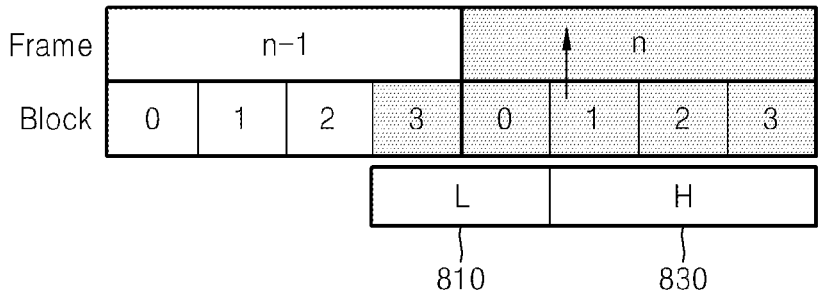
FIG. 8 is a diagram for describing an operation of a second transient determination unit in FIG. 7, according to an exemplary embodiment.

An operation of the second transient determination unit 716 will now be described with a case where one frame consists of four blocks, i.e., where four subframes, 0, 1, 2, and 3 are allocated to the four blocks, and the frame is detected to be transient based on a second block 1 of a frame n as shown in FIG. 8.

First, in detail, a first average of short-term energy of a first plurality of blocks L 810 existing before the second block 1 of the frame n may be compared with a second average of short-term energy of a second plurality of blocks H 830 including the second block 1 and blocks existing thereafter in the frame n. In this case, according to a location detected as transient, the number of blocks included in the first plurality of blocks L 810 and the number of blocks included in the second plurality of blocks H 830 may vary. That is, a ratio of an average of short-term energy of a first plurality of blocks including a block which has been detected to be transient therefrom and blocks existing thereafter, i.e., the second average, to an average of short-term energy of a second plurality of blocks existing before the block which has been detected to be transient therefrom, i.e., the first average, may be calculated.

Next, a ratio of a third average of short-term energy of a frame n before the high pass filtering to a fourth average of short-term energy of the frame n after the high pass filtering may be calculated.

Finally, if the ratio of the second average to the first average is between a first threshold and a second threshold, and the ratio of the third average and the fourth average is greater than a third threshold, even though the first transient determination unit 715 has primarily determined that the current frame is a transient frame, the second transient determination unit 716 may make a final determination that the current frame is a normal frame.

The first to third thresholds may be set in advance through experiments or simulations. For example, the first threshold and the second threshold may be set to 0.7 and 2.0, respectively, and the third threshold may be set to 50 for a super-wideband signal and 30 for a wideband signal.

The two comparison processes performed by the second transient determination unit 716 may prevent an error in which a signal having a temporarily large amplitude is detected to be transient.

Referring back to FIG. 7, the signaling information generation unit 717 may determine whether a frame type of the current frame is updated according to a hangover flag of a previous frame from a result of the determination in the second transient determination unit 716, differently set a hangover flag of the current frame according to a location of a block which is of the current frame and has been detected to be transient, and generate a result thereof as transient signaling information. This will now be described in detail with reference to FIG. 9.

Figure 9:
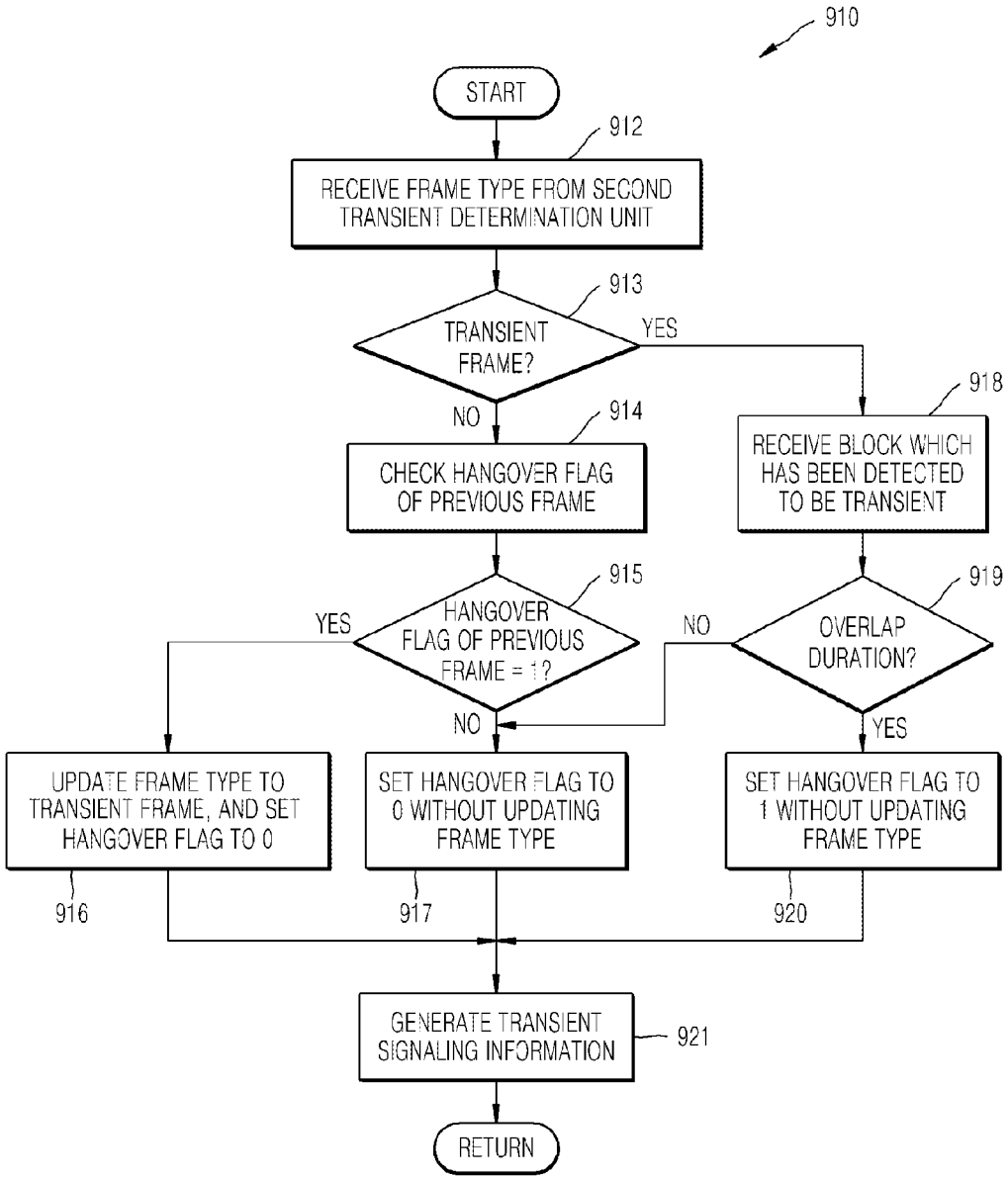
FIG. 9 is a flowchart for describing an operation of a signaling information generation unit in FIG. 7, according to an exemplary embodiment.

FIG. 9 is a flowchart for describing an operation of the signaling information generation unit 717 shown in FIG. 7, according to an exemplary embodiment. FIG. 9 illustrates a case where one frame is constructed as in FIG. 8, a transform window having an overlap duration less than 50% is used, and an overlap occurs in blocks 2 and 3.

Referring to FIG. 9, in operation 912, a finally determined frame type of the current frame may be received from the second transient determination unit 716.

In operation 913, it may be determined, based on the frame type of the current frame, whether the current frame is a transient frame.

If it is determined in operation 913 that the frame type of the current frame does not indicate a transient frame, then in operation 914, a hangover flag set for a previous frame may be checked.

In operation 915, it may be determined whether the hangover flag of the previous frame is 1, and, if as a result of the determination in operation 915, the hangover flag of the previous frame is 1, that is, if the previous frame is a transient frame affecting overlapping, the current frame that is not a transient frame may be updated to a transient frame, and the hangover flag of the current frame may be then set to 0 for a next frame in operation 916. The setting of the hangover flag of the current frame to 0 indicates that the next frame is not affected by the current frame, since the current frame is a transient frame updated due to the previous frame.

If the hangover flag of the previous frame is 0 as a result of the determination in operation 915, then in operation 917, the hangover flag of the current frame may be set to 0 without updating the frame type. That is, it is maintained that the frame type of the current frame is not a transient frame.

If the frame type of the current frame indicates a transient frame as a result of the determination in operation 913, then in operation 918, a block which has been detected in the current frame and determined to be transient may be received.

In operation 919, it may be determined whether the block which has been detected in the current frame and determined to be transient corresponds to an overlap duration, e.g., in FIG. 8, it is determined whether the number of the block which has been detected in the current frame and determined to be transient is greater than 1, i.e., is 2 or 3. If it is determined in operation 919 that the block which has been detected in the current frame and determined to be transient does not correspond to 2 or 3, which indicates an overlap duration, the hangover flag of the current frame may be set to 0 without updating the frame type in operation 917. That is, if the number of the block which has been detected in the current frame and determined to be transient is 0, the frame type of the current frame may be maintained as a transient frame, and the hangover flag of the current frame may be set to 0 so as not to affect the next frame.

If, as a result of the determination in operation 919, the block which has been detected in the current frame and determined to be transient corresponds to 2 or 3, indicating an overlap duration, then in operation 920, the hangover flag of the current frame may be set to 1 without updating the frame type. That is, although the frame type of the current frame is maintained as a transient frame, the current frame may affect the next frame. This indicates that if the hangover flag of the current frame is 1, even though it is determined that the next frame is not a transient frame, the next frame may be updated as a transient frame.

In operation 921, the hangover flag of the current frame and the frame type of the current frame may be formed as transient signaling information. In particular, the frame type of the current frame, i.e., signaling information indicating whether the current frame is a transient frame, may be provided to an audio decoding apparatus.

Figure 10:
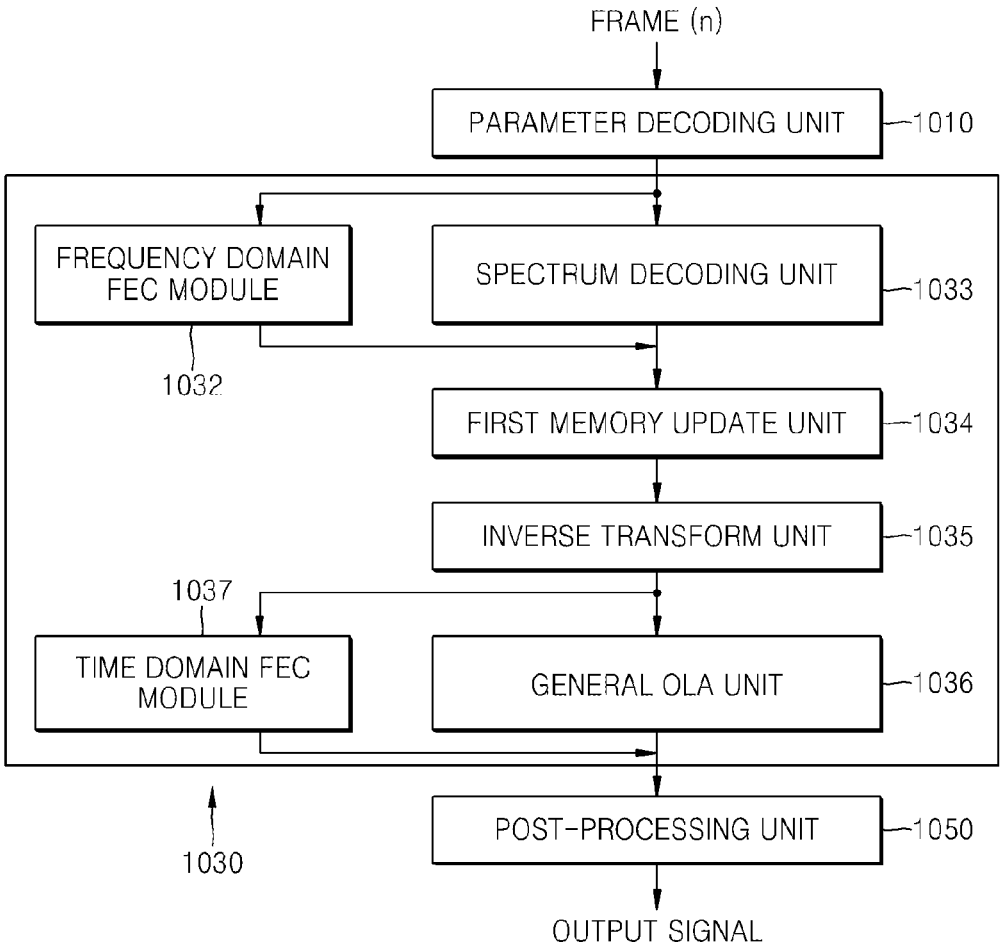
FIG. 10 is a block diagram of a frequency domain audio decoding apparatus according to an exemplary embodiment.

FIG. 10 is a block diagram of a frequency domain audio decoding apparatus 1030 according to an exemplary embodiment, which may correspond to the frequency domain decoding unit 134 of FIG. 1B, the frequency domain decoding unit 234 of FIG. 2B, the frequency domain excitation decoding unit 334 of FIG. 3B, or the frequency domain decoding unit 434 of FIG. 4B.

The frequency domain audio decoding apparatus 1030 shown in FIG. 10 may include a frequency domain frame error concealment (FEC) module 1032, a spectrum decoding unit 1033, a first memory update unit 1034, an inverse transform unit 1035, a general overlap and add (OLA) unit 1036, and a time domain FEC module 1037. The components except for a memory (not shown) embedded in the first memory update unit 1034 may be integrated in at least one module and may be implemented as at least one processor (not shown). Functions of the first memory update unit 1034 may be distributed to and included in the frequency domain FEC module 1032 and the spectrum decoding unit 1033.

Referring to FIG. 10, a parameter decoding unit 1010 may decode parameters from a received bitstream and check from the decoded parameters whether an error has occurred in frame units. The parameter decoding unit 1010 may correspond to the parameter decoding unit 132 of FIG. 1B, the parameter decoding unit 232 of FIG. 2B, the parameter decoding unit 332 of FIG. 3B, or the parameter decoding unit 432 of FIG. 4B. Information provided by the parameter decoding unit 1010 may include an error flag indicating whether a current frame is an error frame and the number of error frames which have continuously occurred until the present. If it is determined that an error has occurred in the current frame, an error flag such as a bad frame indicator (BFI) may be set to 1, indicating that no information exists for the error frame.

The frequency domain FEC module 1032 may have a frequency domain error concealment algorithm therein and operate when the error flag BFI provided by the parameter decoding unit 1010 is 1, and a decoding mode of a previous frame is the frequency domain mode. According to an exemplary embodiment, the frequency domain FEC module 1032 may generate a spectral coefficient of the error frame by repeating a synthesized spectral coefficient of a PGF stored in a memory (not shown). In this case, the repeating process may be performed by considering a frame type of the previous frame and the number of error frames which have occurred until the present. For convenience of description, when the number of error frames which have continuously occurred is two or more, this occurrence corresponds to a burst error.

According to an exemplary embodiment, when the current frame is an error frame forming a burst error and the previous frame is not a transient frame, the frequency domain FEC module 1032 may forcibly down-scale a decoded spectral coefficient of a PGF by a fixed value of 3 dB from, for example, a fifth error frame. That is, if the current frame corresponds to a fifth error frame from among error frames which have continuously occurred, the frequency domain FEC module 1032 may generate a spectral coefficient by decreasing energy of the decoded spectral coefficient of the PGF and repeating the energy decreased spectral coefficient for the fifth error frame.

According to another exemplary embodiment, when the current frame is an error frame forming a burst error and the previous frame is a transient frame, the frequency domain FEC module 1032 may forcibly down-scale a decoded spectral coefficient of a PGF by a fixed value of 3 dB from, for example, a second error frame. That is, if the current frame corresponds to a second error frame from among error frames which have continuously occurred, the frequency domain FEC module 1032 may generate a spectral coefficient by decreasing energy of the decoded spectral coefficient of the PGF and repeating the energy decreased spectral coefficient for the second error frame.

According to another exemplary embodiment, when the current frame is an error frame forming a burst error, the frequency domain FEC module 1032 may decrease modulation noise generated due to the repetition of a spectral coefficient for each frame by randomly changing a sign of a spectral coefficient generated for the error frame. An error frame to which a random sign starts to be applied in an error frame group forming a burst error may vary according to a signal characteristic. According to an exemplary embodiment, a position of an error frame to which a random sign starts to be applied may be differently set according to whether the signal characteristic indicates that the current frame is transient, or a position of an error frame from which a random sign starts to be applied may be differently set for a stationary signal from among signals that are not transient. For example, when it is determined that a harmonic component exists in an input signal, the input signal may be determined as a stationary signal of which signal fluctuation is not severe, and an error concealment algorithm corresponding to the stationary signal may be performed. Commonly, information transmitted from an encoder may be used for harmonic information of an input signal. When low complexity is not necessary, harmonic information may be obtained using a signal synthesized by a decoder.

A random sign may be applied to all the spectral coefficients of an error frame or to spectral coefficients in a frequency band higher than a pre-defined frequency band because the better performance may be expected by not applying a random sign in a very low frequency band that is equal to or less than, for example, 200 Hz. This is because, in the low frequency band, a waveform or energy may considerably change due to a change in sign.

According to another exemplary embodiment, the frequency domain FEC module 1032 may apply the down-scaling or the random sign for not only error frames forming a burst error but also in a case where every other frame is an error frame. That is, when a current frame is an error frame, a one-frame previous frame is a normal frame, and a two-frame previous frame is an error frame, the down-scaling or the random sign may be applied.

The spectrum decoding unit 1033 may operate when the error flag BFI provided by the parameter decoding unit 1010 is 0, i.e., when a current frame is a normal frame. The spectrum decoding unit 1033 may synthesize spectral coefficients by performing spectrum decoding using the parameters decoded by the parameter decoding unit 1010. The spectrum decoding unit 1033 will be described below in more detail with reference to FIGS. 11 and 12.

The first memory update unit 1034 may update, for a next frame, the synthesized spectral coefficients, information obtained using the decoded parameters, the number of error frames which have continuously occurred until the present, information on a signal characteristic or frame type of each frame, and the like with respect to the current frame that is a normal frame. The signal characteristic may include a transient characteristic or a stationary characteristic, and the frame type may include a transient frame, a stationary frame, or a harmonic frame.

The inverse transform unit 1035 may generate a time domain signal by performing a time-frequency inverse transform on the synthesized spectral coefficients. The inverse transform unit 1035 may provide the time domain signal of the current frame to one of the general OLA unit 1036 and the time domain FEC module 1037 based on an error flag of the current frame and an error flag of the previous frame.

The general OLA unit 1036 may operate when both the current frame and the previous frame are normal frames. The general OLA unit 1036 may perform general OLA processing by using a time domain signal of the previous frame, generate a final time domain signal of the current frame as a result of the general OLA processing, and provide the final time domain signal to a post-processing unit 1050.

The time domain FEC module 1037 may operate when the current frame is an error frame or when the current frame is a normal frame, the previous frame is an error frame, and a decoding mode of the latest PGF is the frequency domain mode. That is, when the current frame is an error frame, error concealment processing may be performed by the frequency domain FEC module 1032 and the time domain FEC module 1037, and when the previous frame is an error frame and the current frame is a normal frame, the error concealment processing may be performed by the time domain FEC module 1037.

Figure 11:
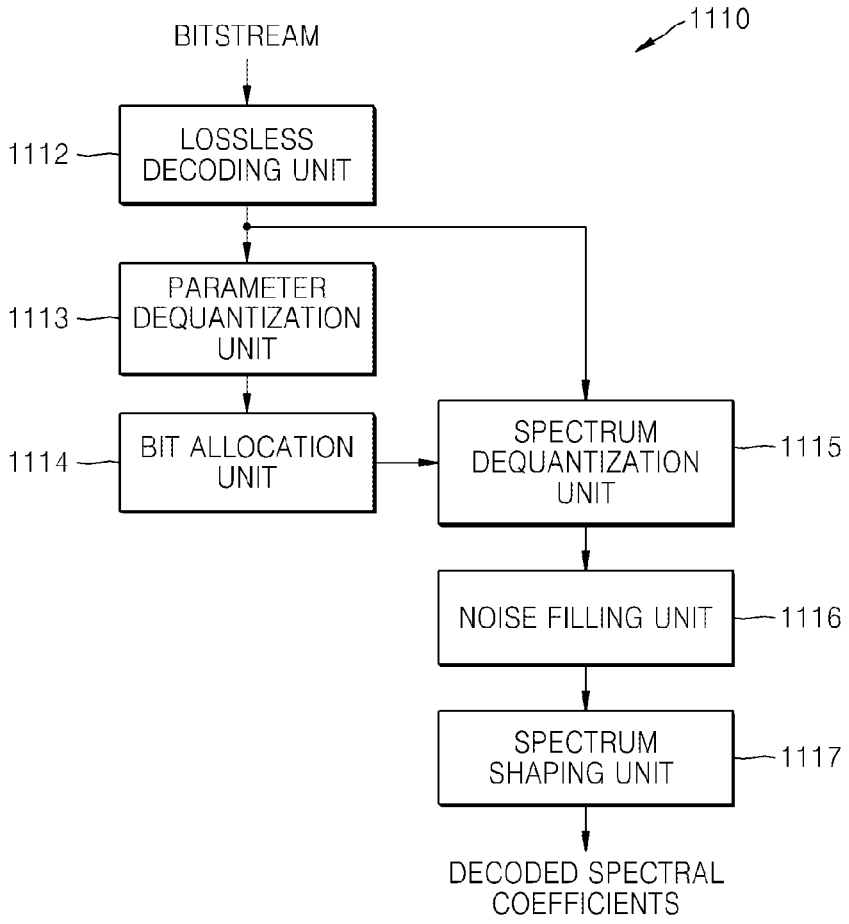
FIG. 11 is a block diagram of a spectrum decoding unit in FIG. 10, according to an exemplary embodiment.

FIG. 11 is a block diagram of the spectrum decoding unit 1033 (referred to as 1110 in FIG. 11) shown in FIG. 10, according to an exemplary embodiment.

The spectrum decoding unit 1110 shown in FIG. 11 may include a lossless decoding unit 1112, a parameter dequantization unit 1113, a bit allocation unit 1114, a spectrum dequantization unit 1115, a noise filling unit 1116, and a spectrum shaping unit 1117. The noise filling unit 1116 may be at a rear end of the spectrum shaping unit 1117. The components may be integrated in at least one module and may be implemented as at least one processor (not shown).

Referring to FIG. 11, the lossless decoding unit 1112 may perform lossless decoding on a parameter for which lossless decoding has been performed in a decoding process, e.g., a Norm value or a spectral coefficient.

The parameter dequantization unit 1113 may dequantize the lossless-decoded Norm value. In the decoding process, the Norm value may be quantized using one of various methods, e.g., vector quantization (VQ), scalar quantization (SQ), trellis coded quantization (TCQ), lattice vector quantization (LVQ), and the like, and dequantized using a corresponding method.

The bit allocation unit 1114 may allocate required bits in sub-band units based on the quantized Norm value or the dequantized Norm value. In this case, the number of bits allocated in sub-band units may be the same as the number of bits allocated in the encoding process.

The spectrum dequantization unit 1115 may generate normalized spectral coefficients by performing a dequantization process using the number of bits allocated in sub-band units.

The noise filling unit 1116 may generate a noise signal and fill the noise signal in a part requiring noise filling in sub-band units from among the normalized spectral coefficients.

The spectrum shaping unit 1117 may shape the normalized spectral coefficients by using the dequantized Norm value. Finally decoded spectral coefficients may be obtained through the spectrum shaping process.

Figure 12:
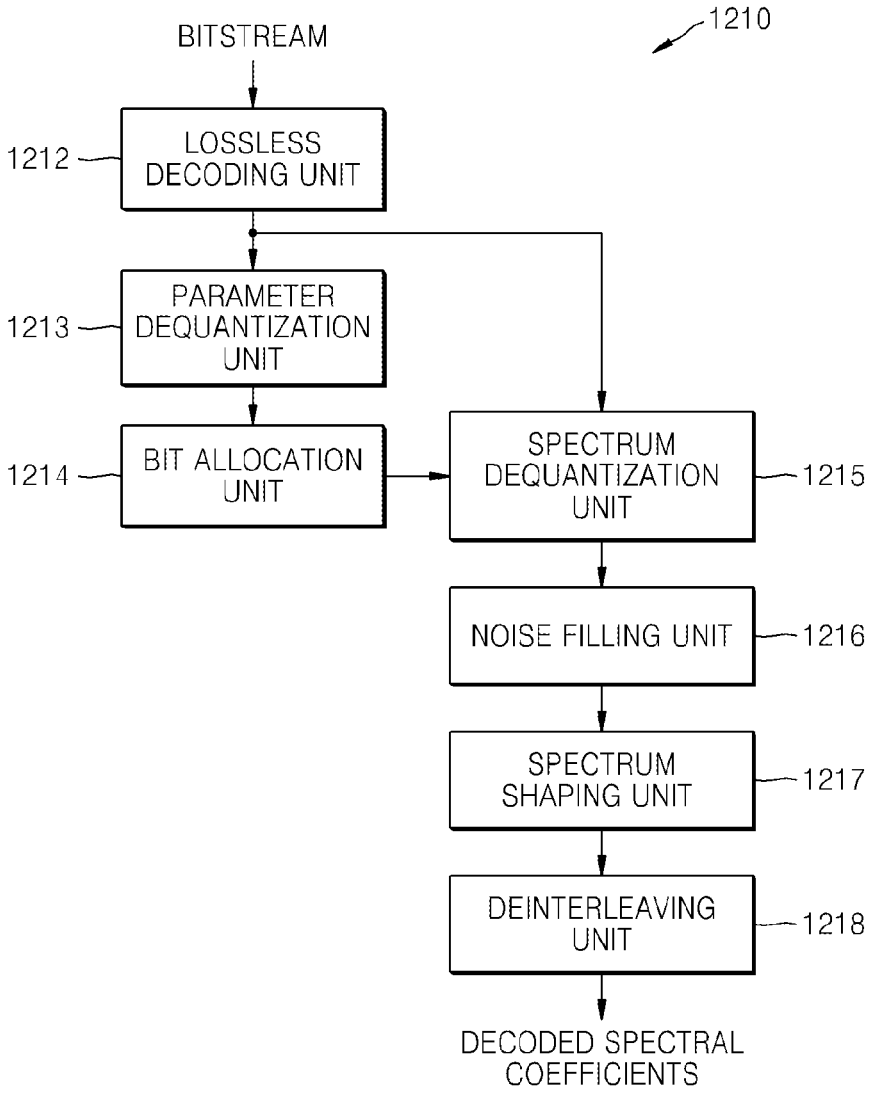
FIG. 12 is a block diagram of a spectrum decoding unit in FIG. 10, according to another exemplary embodiment.

FIG. 12 is a block diagram of the spectrum decoding unit 1033 (referred to as 1210 in FIG. 12) shown in FIG. 10, according to another exemplary embodiment, which may be preferably applied to a case where a short window is used for a frame of which signal fluctuation is severe, e.g., a transient frame.

The spectrum decoding unit 1210 shown in the FIG. 12 may include a lossless decoding unit 1212, a parameter dequantization unit 1213, a bit allocation unit 1214, a spectrum dequantization unit 1215, a noise filling unit 1216, a spectrum shaping unit 1217, and a deinterleaving unit 1218. The noise filling unit 1216 may be at a rear end of the spectrum shaping unit 1217. The components may be integrated in at least one module and may be implemented as at least one processor (not shown). Compared with the spectrum decoding unit 1110 shown in FIG. 11, the deinterleaving unit 1218 is further added, and thus, the description of operations of the same components is not repeated.

Figure 13:
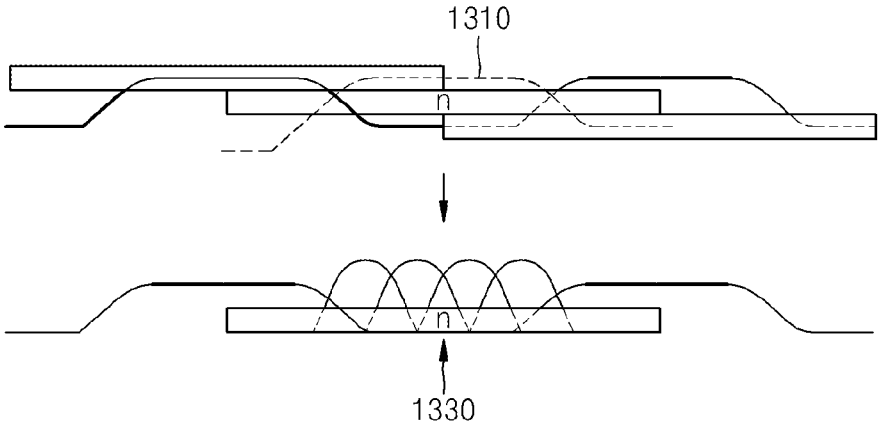
FIG. 13 is a diagram for describing an operation of a deinterleaving unit in FIG. 12, according to an exemplary embodiment.

First, when a current frame is a transient frame, a transform window to be used needs to be shorter than a transform window (refer to 1310 of FIG. 13) used for a stationary frame. According to an exemplary embodiment, the transient frame may be split to four subframes, and a total of four short windows (refer to 1330 of FIG. 13) may be used as one for each subframe. Before the description of an operation of the deinterleaving unit 1218, interleaving processing in an encoder end will now be described.

It may be set such that a sum of spectral coefficients of four subframes, which are obtained using four short windows when a transient frame is split to the four subframes, is the same as a sum of spectral coefficients obtained using one long window for the transient frame. First, a transform is performed by applying the four short windows, and as a result, four sets of spectral coefficients may be obtained. Next, interleaving may be continuously performed in an order of spectral coefficients of each set. In detail, if it is assumed that spectral coefficients of a first short window are c01, c02, . . . , c0n, spectral coefficients of a second short window are c11, c12, . . . , c1 n, spectral coefficients of a third short window are c21, c22, . . . , c2n, and spectral coefficients of a four short window are c31, c32, . . . , c3n, then a result of the interleaving may be c01, c11, c21, c31, . . . , c0n, c1 n, c2n, c3n.

As described above, by the interleaving process, a transient frame may be updated the same as a case where a long window is used, and a subsequent encoding process, such as quantization and lossless encoding, may be performed.

Referring back to FIG. 12, the deinterleaving unit 1218 may be used to update reconstructed spectral coefficients provided by the spectrum shaping unit 1217 to a case where short windows are originally used. A transient frame has a characteristic that energy fluctuation is severe and commonly tends to have low energy in a beginning part and have high energy in an ending part. Thus, when a PGF is a transient frame, if reconstructed spectral coefficients of the transient frame are repeatedly used for an error frame, since frames of which energy fluctuation is severe exist continuously, noise may be very large. To prevent this, when a PGF is a transient frame, spectral coefficients of an error frame may be generated using spectral coefficients decoded using third and fourth short windows instead of spectral coefficients decoded using first and second short windows.

Figure 14:
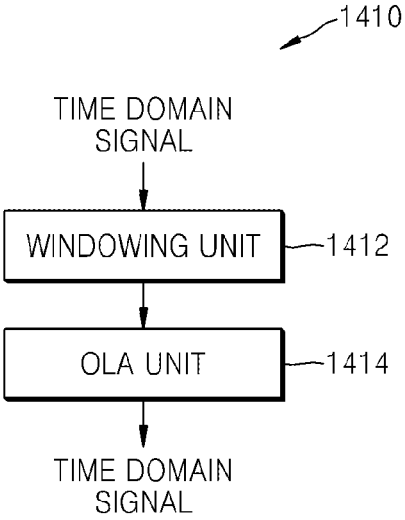
FIG. 14 is a block diagram of an overlap and add (OLA) unit in FIG. 10, according to an exemplary embodiment.

FIG. 14 is a block diagram of the general OLA unit 1036 (referred to as 1410 in FIG. 14) shown in FIG. 10, according to an exemplary embodiment, wherein the general OLA unit 1036 (referred to as 1410 in FIG. 14) may operate when a current frame and a previous frame are normal frames and perform OLA processing on the time domain signal, i.e., an IMDCT signal, provided by the inverse transform unit (1035 of FIG. 10).

The general OLA unit 1410 shown in FIG. 14 may include a windowing unit 1412 and an OLA unit 1414.

Referring to FIG. 14, the windowing unit 1412 may perform windowing processing on an IMDCT signal of a current frame to remove time domain aliasing. A case where a window having an overlap duration less than 50% will be described below with reference to FIGS. 19A and 19B.

The OLA unit 1414 may perform OLA processing on the windowed IMDCT signal.

Figure 19A:
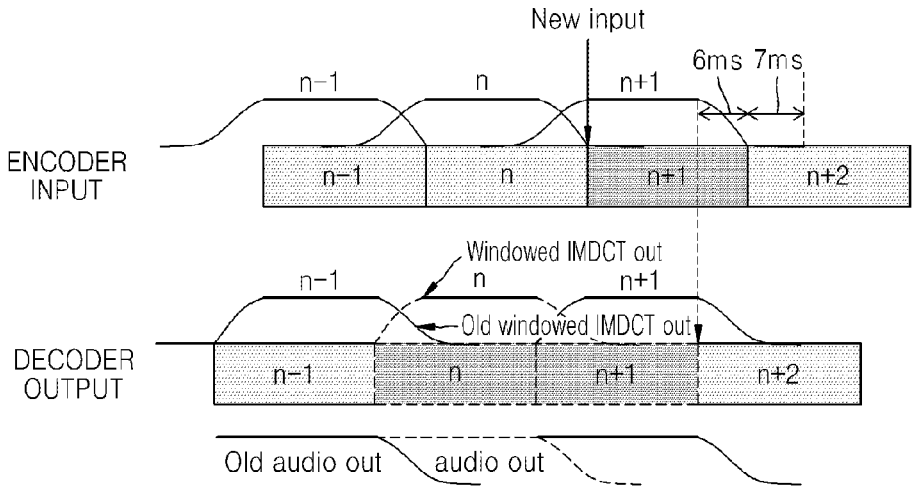
FIGS. 19A and 19B are diagrams for describing an example of windowing processing performed by an encoding apparatus and a decoding apparatus to remove time domain aliasing when a transform window having an overlap duration less than 50% is used.
Figure 19B:
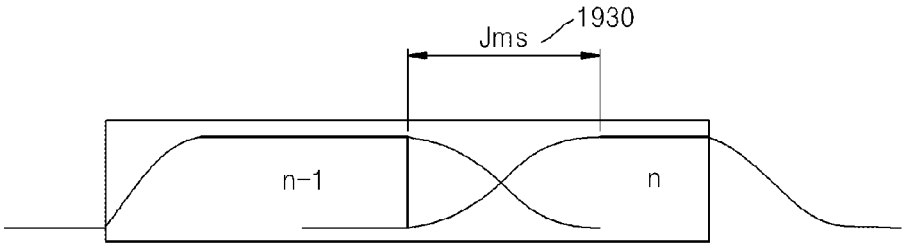

FIGS. 19A and 19B are diagrams for describing an example of windowing processing performed by an encoding apparatus and a decoding apparatus to remove time domain aliasing when a window having an overlap duration less than 50% is used.

Referring to FIGS. 19A and 19B, a format of a window used by the encoding apparatus and a format of a window used by the decoding apparatus may be represented in mutually reverse directions. The encoding apparatus applies windowing by using a past stored signal when a new input is received. When a size of an overlap duration is reduced to prevent a time delay, the overlap duration may be located at both ends of a window. The decoding apparatus derives an audio output signal by performing OLA processing on an old audio output signal of FIG. 19A in a current frame n, where a region of the current frame n is the same as that of an old windowed IMDCT out signal. A future region of the audio output signal is used for an OLA process in a next frame. FIG. 19B illustrates a format of a window for concealing an error frame according to an exemplary embodiment. When an error occurs in frequency domain encoding, past spectral coefficients are usually repeated, and thus, it may be impossible to remove time domain aliasing in the error frame. Thus, a modified window may be used to conceal artifacts due to the time domain aliasing. In particular, when a window having an overlap duration less than 50% is used, to reduce noise due to the short overlap duration, overlapping may be smoothed by adjusting a length of an overlap duration 1930 to be J ms (0<J<frame size).

Figure 15:
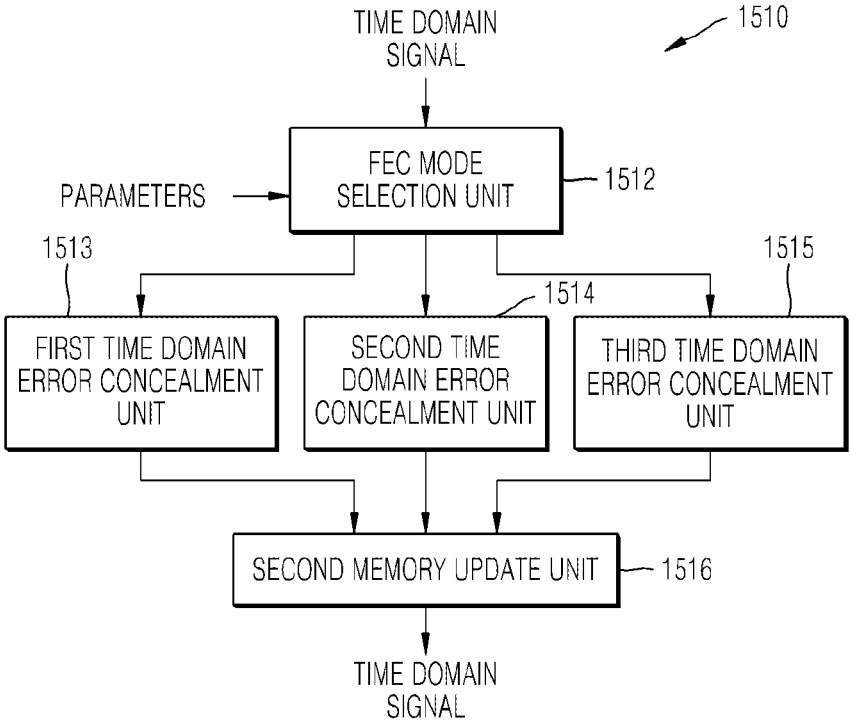
FIG. 15 is a block diagram of an error concealment and OLA unit of FIG. 10, according to an exemplary embodiment.

FIG. 15 is a block diagram of the time domain FEC module 1037 shown in FIG. 10, according to an exemplary embodiment.

The time domain FEC module 1510 shown in FIG. 15 may include an FEC mode selection unit 1512, first to third time domain error concealment units 1513, 1514, and 1515, and a second memory update unit 1516. Functions of the second memory update unit 1516 may be included in the first to third time domain error concealment units 1513, 1514, and 1515.

Referring to FIG. 15, the FEC mode selection unit 1512 may select an FEC mode in the time domain by receiving an error flag BFI of a current frame, an error flag Prev_BFI of a previous frame, and the number of continuous error frames. For the error flags, 1 may indicate an error frame, and 0 may indicate a normal frame. When the number of continuous error frames is equal to or greater than, for example, 2, it may be determined that a burst error is formed. As a result of the selection in the FEC mode selection unit 1512, a time domain signal of the current frame may be provided to one of the first to third time domain error concealment units 1513, 1514, and 1515.

The first time domain error concealment unit 1513 may perform error concealment processing when the current frame is an error frame.

The second time domain error concealment unit 1514 may perform error concealment processing when the current frame is a normal frame and the previous frame is an error frame forming a random error.

The third time domain error concealment unit 1515 may perform error concealment processing when the current frame is a normal frame and the previous frame is an error frame forming a burst error.

The second memory update unit 1516 may update various kinds of information used for the error concealment processing on the current frame and store the information in a memory (not shown) for a next frame.

Figure 16:
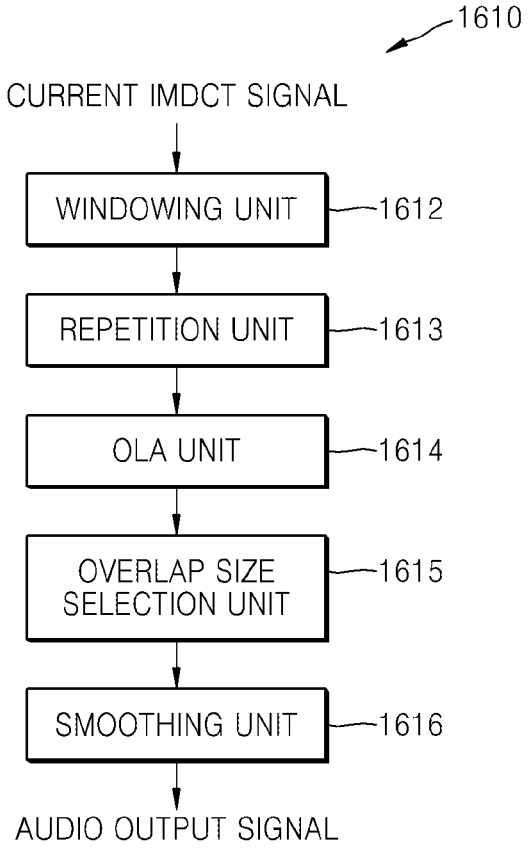
FIG. 16 is a block diagram of a first error concealment unit in FIG. 15, according to an exemplary embodiment.

FIG. 16 is a block diagram of the first time domain error concealment unit 1513 shown in FIG. 15, according to an exemplary embodiment. When a current frame is an error frame, if a method of repeating past spectral coefficients obtained in the frequency domain is generally used, if OLA processing is performed after IMDCT and windowing, a time domain aliasing component in a beginning part of the current frame varies, and thus perfect reconstruction may be impossible, thereby resulting in unexpected noise. The first time domain error concealment unit 1513 may be used to minimize the occurrence of noise even though the repetition method is used.

The first time domain error concealment unit 1610 shown in FIG. 16 may include a windowing unit 1612, a repetition unit 1613, an OLA unit 1614, an overlap size selection unit 1615, and a smoothing unit 1616.

Referring to FIG. 16, the windowing unit 1612 may perform the same operation as that of the windowing unit 1412 of FIG. 14.

The repetition unit 1613 may apply a repeated two-frame previous (referred to as "previous old") IMDCT signal to a beginning part of a current frame that is of an error frame.

The OLA unit 1614 may perform OLA processing on the signal repeated by the repetition unit 1613 and an IMDCT signal of the current frame. As a result, an audio output signal of the current frame may be generated, and the occurrence of noise in a beginning part of the audio output signal may be reduced by using the two-frame previous signal. Even when scaling is applied together with the repetition of a spectrum of a previous frame in the frequency domain, the possibility of the occurrence of noise in the beginning part of the current frame may be much reduced.

The overlap size selection unit 1615 may select a length ov_size of an overlap duration of a smoothing window to be applied in smoothing processing, wherein ov_size may be always a same value, e.g., 12 ms for a frame size of 20 ms, or may be variably adjusted according to specific conditions. The specific conditions may include harmonic information of the current frame, an energy difference, and the like. The harmonic information indicates whether the current frame has a harmonic characteristic and may be transmitted from the encoding apparatus or obtained by the decoding apparatus. The energy difference indicates an absolute value of a normalized energy difference between energy $E_{curr}$ of the current frame and a moving average $E_{MA}$ of per-frame energy. The energy difference may be represented by Equation 1.

$$\text{Diff_energy} = \left|\frac{(E_{curr} - E_{MA})}{E_{MA}}\right| \tag{1}$$

In Equation 1, $E_{MA}=0.8*E_{MA}+0.2*E_{curr}$.

The smoothing unit 1616 may apply the selected smoothing window between a signal of a previous frame (old audio output) and a signal of the current frame (referred to as "current audio output") and perform OLA processing. The smoothing window may be formed such that a sum of overlap durations between adjacent windows is 1. Examples of a window satisfying this condition are a sine wave window, a window using a primary function, and a Hanning window, but the smoothing window is not limited thereto. According to an exemplary embodiment, the sine wave window may be used, and in this case, a window function w(n) may be represented by Equation 2.

$$w(n) = \sin^2\left(\frac{\pi n}{2 * \text{ov_size}}\right), \quad n = 0, \ldots, \text{ov_size} - 1 \tag{2}$$

In Equation 2, ov_size denotes a length of an overlap duration to be used in smoothing processing, which is selected by the overlap size selection unit 1615.

By performing smoothing processing as described above, when the current frame is an error frame, discontinuity between the previous frame and the current frame, which may occur by using an IMDCT signal copied from the two-frame previous frame instead of an IMDCT signal stored in the previous frame, may be prevented.

Figure 17:
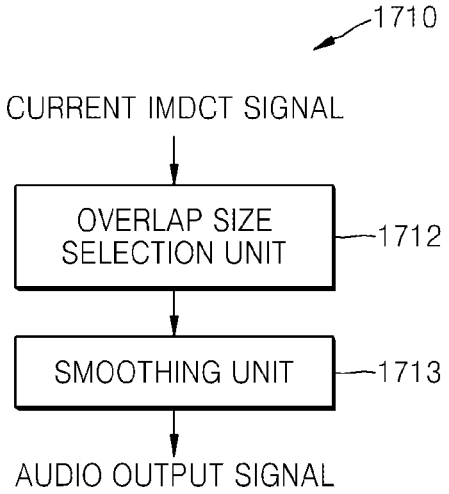
FIG. 17 is a block diagram of a second error concealment unit in FIG. 15, according to an exemplary embodiment.

FIG. 17 is a block diagram of the second time domain error concealment unit 1514 shown in FIG. 15, according to an exemplary embodiment.

The second time domain error concealment unit 1710 shown in FIG. 17 may include an overlap size selection unit 1712 and a smoothing unit 1713.

Referring to FIG. 17, the overlap size selection unit 1712 may select a length ov_size of an overlap duration of a smoothing window to be applied in smoothing processing as in the overlap size selection unit 1615 of FIG. 16.

The smoothing unit 1713 may apply the selected smoothing window between an old IMDCT signal and a current IMDCT signal and perform OLA processing. Likewise, the smoothing window may be formed such that a sum of overlap durations between adjacent windows is 1.

That is, when a previous frame is a random error frame and a current frame is a normal frame, since normal windowing is impossible, it is difficult to remove time domain aliasing in an overlap duration between an IMDCT signal of the previous frame and an IMDCT signal of the current frame. Thus, noise may be minimized by performing smoothing processing instead of OLA processing.

Figure 18:
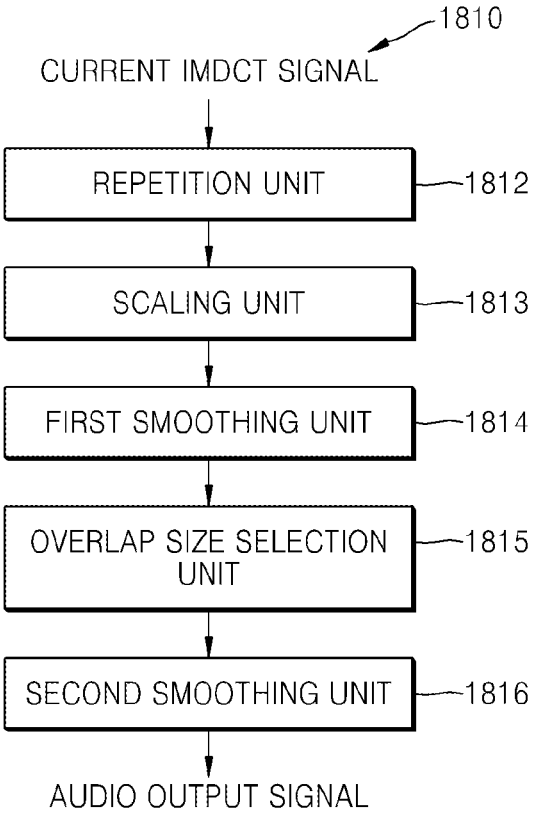
FIG. 18 is a block diagram of a third error concealment unit in FIG. 15, according to an exemplary embodiment.

FIG. 18 is a block diagram of the third time domain error concealment unit 1515 shown in FIG. 15, according to an exemplary embodiment.

The third time domain error concealment unit 1810 shown in FIG. 18 may include a repetition unit 1812, a scaling unit 1813, a first smoothing unit 1814, an overlap size selection unit 1815, and a second smoothing unit 1816.

Referring to FIG. 18, the repetition unit 1812 may copy, to a beginning part of a current frame, a part corresponding to a next frame in an IMDCT signal of the current frame that is a normal frame.

The scaling unit 1813 may adjust a scale of the current frame to prevent a sudden signal increase. According to an exemplary embodiment, the scaling unit 1813 may perform down-scaling of 3 dB. The scaling unit 1813 may be optional.

The first smoothing unit 1814 may apply a smoothing window to an IMDCT signal of a previous frame and an IMDCT signal copied from a future frame and perform OLA processing. Likewise, the smoothing window may be formed such that a sum of overlap durations between adjacent windows is 1. That is, when a future signal is copied, windowing is necessary to remove the discontinuity which may occur between the previous frame and the current frame, and a past signal may be replaced by the future signal by OLA processing.

Like the overlap size selection unit 1615 of FIG. 16, the overlap size selection unit 1815 may select a length ov_size of an overlap duration of a smoothing window to be applied in smoothing processing.

The second smoothing unit 1816 may perform the OLA processing while removing the discontinuity by applying the selected smoothing window between an old IMDCT signal that is a replaced signal and a current IMDCT signal that is a current frame signal. Likewise, the smoothing window may be formed such that a sum of overlap durations between adjacent windows is 1.

That is, when the previous frame is a burst error frame and the current frame is a normal frame, since normal windowing is impossible, time domain aliasing in the overlap duration between the IMDCT signal of the previous frame and the IMDCT signal of the current frame cannot be removed. In the burst error frame, since noise or the like may occur due to a decrease in energy or continuous repetitions, a method of copying a future signal for the overlapping of the current frame may be applied. In this case, smoothing processing may be performed twice to remove noise which may occur in the current frame and simultaneously remove the discontinuity which may occur between the previous frame and the current frame.

Figure 20A:
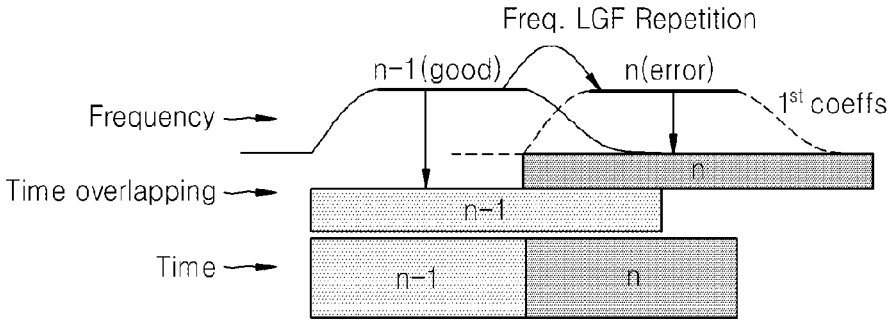
FIGS. 20A and 20B are diagrams for describing an example of OLA processing using a time domain signal of an NGF in FIG. 18.
Figure 20B:
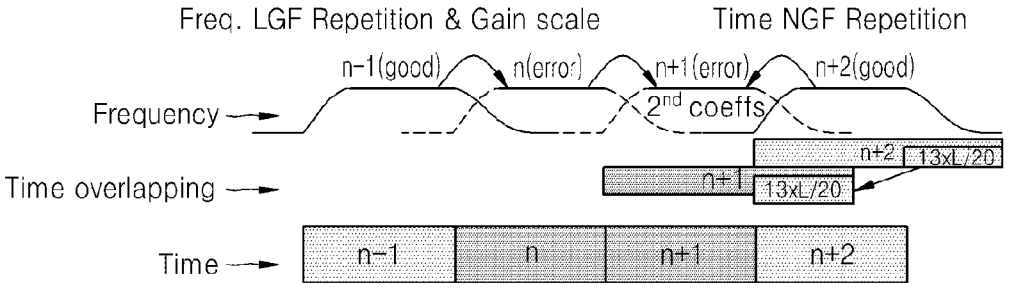

FIGS. 20A and 20B are diagrams for describing an example of OLA processing using a time domain signal of an NGF in FIG. 18.

FIG. 20A illustrates a method of performing repetition or gain scaling by using a previous frame when the previous frame is not an error frame. Referring to FIG. 20B, so that an additional delay is not used, overlapping is performed by repeating a time domain signal decoded in a current frame that is an NGF to the past only for a part which has not been decoded through overlapping, and gain scaling is further performed. A size of a signal to be repeated may be selected as a value that is less than or equal to a size of an overlapping part. According to an exemplary embodiment, the size of the overlapping part may be 13*L/20, where L is, for example, 160 for a narrowband (NB), 320 for a wideband (WB), 640 for a super-wideband (SWB), and 960 for the full band (FB).

A method of obtaining a time domain signal of an NGF through repetition to derive a signal to be used for a time overlapping process will now be described.

In FIG. 20B, scale adjustment may be performed by copying a block having a size of 13*L/20, which is marked in a future part of a frame n+2, to a future part of a frame n+1, which corresponds to the same location as the future part of the frame n+2, to replace an existing value of the future part of the frame n+1 by a value of the future part of the frame n+2. The scaled value is, for example, −3 dB. To remove the discontinuity between the frame n+2 and the frame n+1 in the copying, a time domain signal obtained from the frame n+1 in FIG. 20B that is a previous frame value and a signal copied from the future part may linearly overlap each other at the first block having the size of 13*L/20. By this process, a final signal for overlapping may be obtained, and when the updated n+1 signal and n+2 signal overlap each other, a final time domain signal of the frame n+2 may be output.

Figure 21:
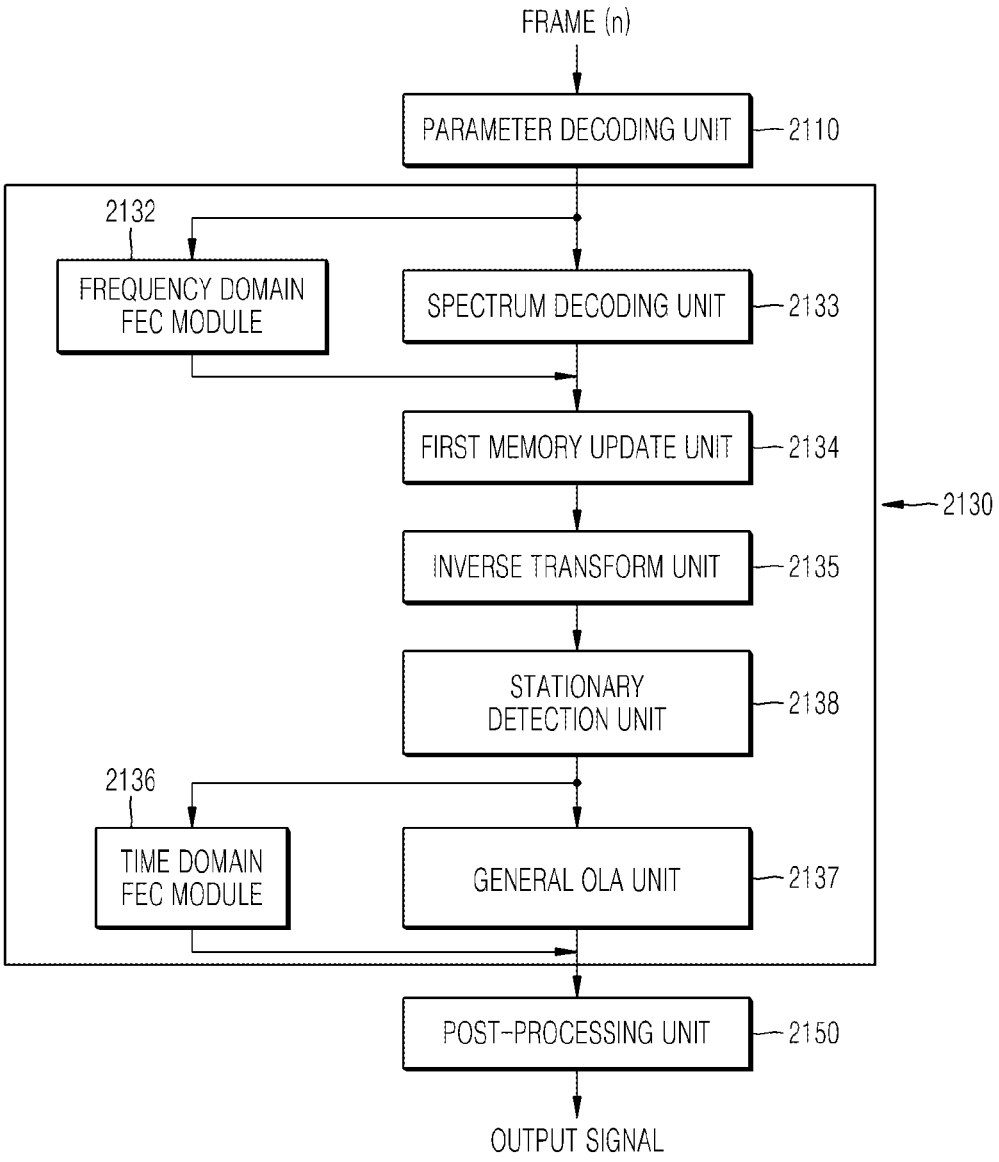
FIG. 21 is a block diagram of a frequency domain audio decoding apparatus according to another exemplary embodiment.

FIG. 21 is a block diagram of a frequency domain audio decoding apparatus 2130 according to another exemplary embodiment. Compared with the embodiment shown in FIG. 10, a stationary detection unit 2138 may be further included. Thus, the detailed description of operations of the same components as those of FIG. 10 is not repeated.

Referring to FIG. 21, the stationary detection unit 2138 may detect whether a current frame is stationary by analyzing a time domain signal provided by an inverse transform unit 2135. A result of the detection in the stationary detection unit 2138 may be provided to a time domain FEC module 2136.

Figure 22:
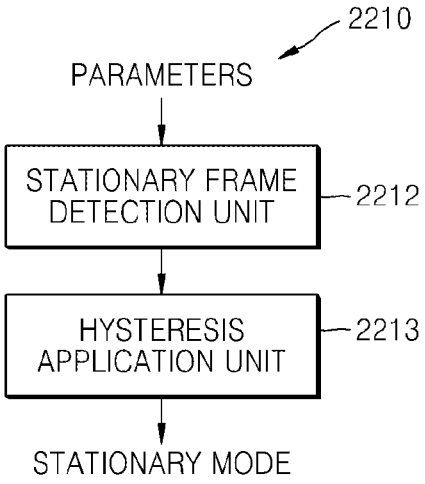
FIG. 22 is a block diagram of a stationary detection unit in FIG. 21, according to an exemplary embodiment.

FIG. 22 is a block diagram of the stationary detection unit 2138 (referred to as 2210 in FIG. 22) shown in FIG. 21, according to an exemplary embodiment. The stationary detection unit 2210 shown in FIG. 21 may include a stationary frame detection unit 2212 and a hysteresis application unit 2213.

Referring to FIG. 22, the stationary frame detection unit 2212 may determine whether a current frame is stationary by receiving information including envelope delta env_delta, a stationary mode stat_mode_old of a previous frame, an energy difference diff_energy, and like. The envelope delta env_delta is obtained using information on the frequency domain and indicates average energy of per-band Norm value differences between the previous frame and the current frame. The envelope delta env_delta may be represented by Equation 3.

$$E_{Ed} = \sum_{k=0}^{n-1} (\text{norm_old}(k) - \text{norm}(k))^2 / \text{nb_sfm} \tag{3}$$

$$E_{Ed_MA} = \text{ENV_SMF} * E_{Ed} + (1 - \text{ENV_SMF}) * E_{Ed_MA}$$

In Equation 3, norm_old(k) denotes a Norm value of a band k of the previous frame, norm(k) denotes a Norm value of the band k of the current frame, nb_sfm denotes the number of bands, $E_{Ed}$ denotes envelope delta of the current frame, $E_{Ed_MA}$ is obtained by applying a smoothing factor to $E_{Ed}$ and may be set as envelope delta to be used for stationary determination, and ENV_SMF denotes the smoothing factor of the envelope delta and may be 0.1 according to an embodiment of the present invention. In detail, a stationary mode stat_mode_curr of the current frame may be set to 1 when the energy difference diff_energy is less than a first threshold and the envelope delta env_delta is less than a second threshold. The first threshold and the second threshold may be 0.032209 and 1.305974, respectively, but are not limited thereto.

If it is determined that the current frame is stationary, the hysteresis application unit 2213 may generate final stationary information stat_mode_out of the current frame by applying the stationary mode stat_mode_old of the previous frame to prevent a frequent change in stationary information of the current frame. That is, if it is determined in the stationary frame detection unit 2212 that the current frame is stationary and the previous frame is stationary, the current frame is detected as a stationary frame.

Figure 23:
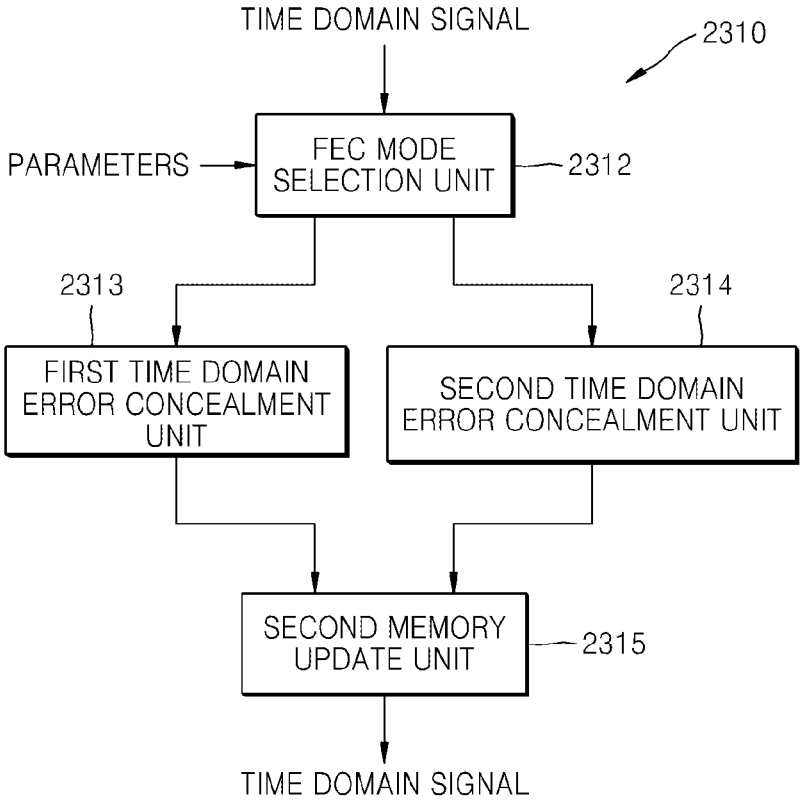
FIG. 23 is a block diagram of an error concealment and OLA unit in FIG. 21, according to an exemplary embodiment.

FIG. 23 is a block diagram of the time domain FEC module 2136 shown in FIG. 21, according to an exemplary embodiment.

The time domain FEC module 2310 shown in FIG. 23 may include an FEC mode selection unit 2312, first and second time domain error concealment units 2313 and 2314, and a first memory update unit 2315. Functions of the first memory update unit 2315 may be included in the first and second time domain error concealment units 2313 and 2314.

Referring to FIG. 23, the FEC mode selection unit 2312 may select an FEC mode in the time domain by receiving an error flag BFI of a current frame, an error flag Prev_BFI of a previous frame, and various parameters. For the error flags, 1 may indicate an error frame, and 0 may indicate a normal frame. As a result of the selection in the FEC mode selection unit 2312, a time domain signal of the current frame may be provided to one of the first and second time domain error concealment units 2313 and 2314.

The first time domain error concealment unit 2313 may perform error concealment processing when the current frame is an error frame.

The second time domain error concealment unit 2314 may perform error concealment processing when the current frame is a normal frame and the previous frame is an error frame.

The first memory update unit 2315 may update various kinds of information used for the error concealment processing on the current frame and store the information in a memory (not shown) for a next frame.

In OLA processing performed by the first and second time domain error concealment units 2313 and 2314, an optimal method may be applied according to whether an input signal is transient or stationary or according to a stationary level when the input signal is stationary. According to an exemplary embodiment, when a signal is stationary, a length of an overlap duration of a smoothing window is set to be long, otherwise, a length used in general OLA processing may be used as it is.

Figure 24:
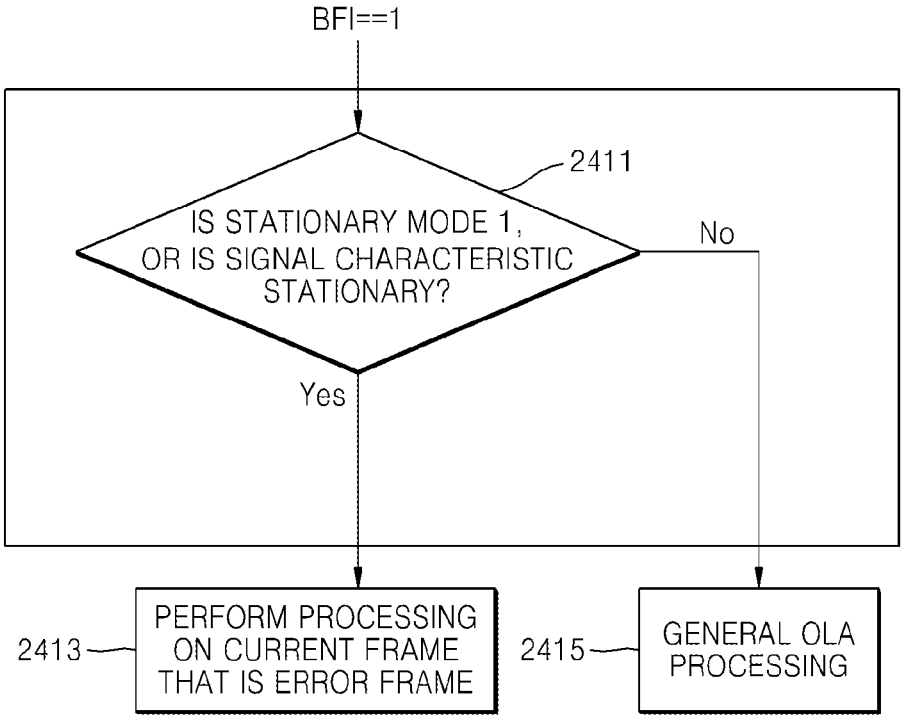
FIG. 24 is a flowchart for describing an operation of an FEC mode selection unit in FIG. 21 when a current frame is an error frame, according to an exemplary embodiment.

FIG. 24 is a flowchart for describing an operation of the FEC mode selection unit 2312 of FIG. 23 when a current frame is an error frame, according to an exemplary embodiment.

In FIG. 24, types of parameters used to select an FEC mode when a current frame is an error frame are as follows; an error flag of the current frame, an error flag of a previous frame, harmonic information of a PGF, harmonic information of an NGF, and the number of continuous error frames. The number of continuous error frames may be reset when the current frame is a normal frame. In addition, the parameters may further include stationary information of the PGF, an energy difference, and envelope delta. Each piece of the harmonic information may be transmitted from an encoder or separately generated by a decoder.

Referring to FIG. 24, in operation 2411, it may be is determined whether the input signal is stationary by using the various parameters. In detail, when the PGF is stationary, the energy difference is less than a first threshold, and the envelope delta of the PGF is less than a second threshold, it may be determined that the input signal is stationary. The first and second thresholds may be set in advance through experiments or simulations.

If it is determined in operation 2411 that the input signal is stationary, then in operation 2413, repetition and smoothing processing may be performed. If it is determined that the input signal is stationary, a length of an overlap duration of a smoothing window may be set to be longer, for example, to 6 ms.

If it is determined in operation 2411 that the input signal is not stationary, then in operation 2415, general OLA processing may be performed.

Figure 25:
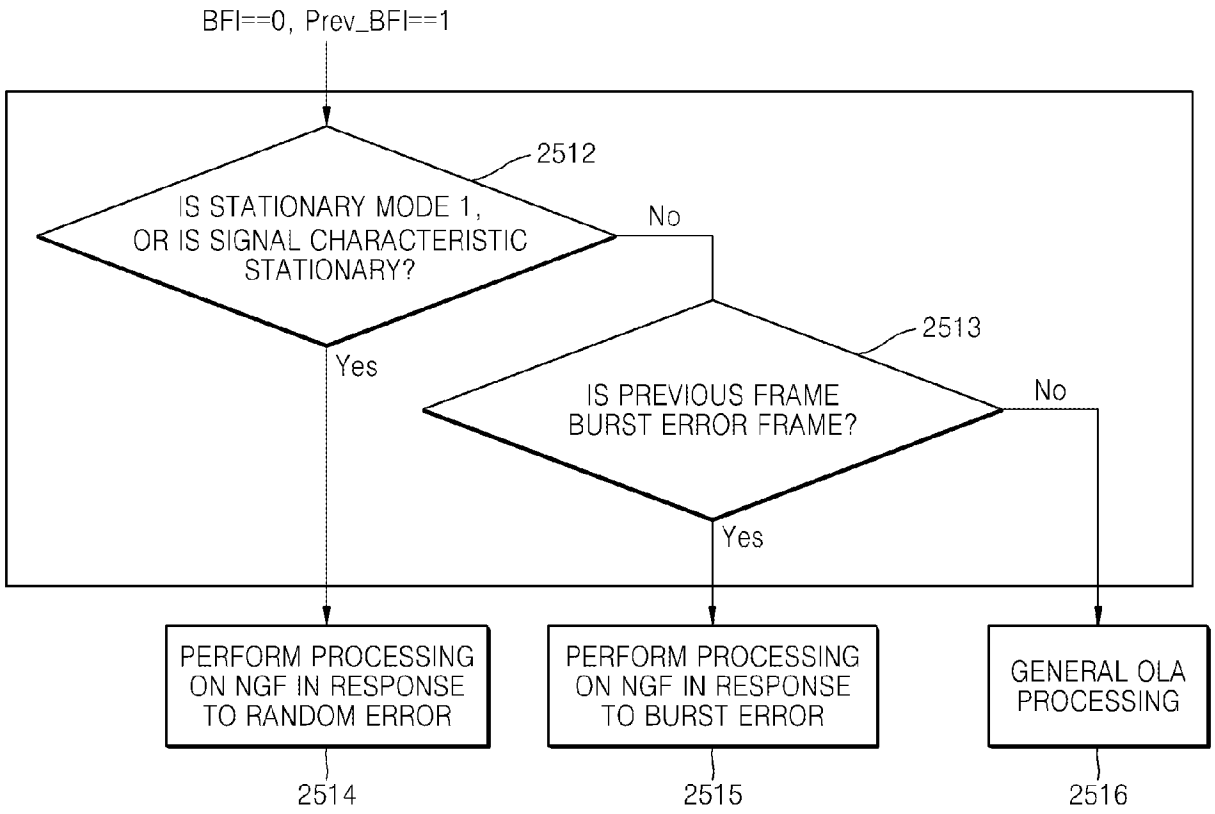
FIG. 25 is a flowchart for describing an operation of the FEC mode selection unit in FIG. 21 when a previous frame is an error frame and a current frame is not an error frame, according to an exemplary embodiment.

FIG. 25 is a flowchart for describing an operation of the FEC mode selection unit 2312 of FIG. 23 when a previous frame is an error frame and a current frame is not an error frame, according to an exemplary embodiment.

Referring to FIG. 25, in operation 2512, it may be determined whether the input signal is stationary by using the various parameters. The same parameters as in operation 2411 of FIG. 24 may be used.

If it is determined in operation 2512 that the input signal is not stationary, then in operation 2513, it may be determined whether the previous frame is a burst error frame by checking whether the number of continuous error frames is greater than 1.

If it is determined in operation 2512 that the input signal is stationary, then in operation 2514, error concealment processing, i.e., repetition and smoothing processing, on an NGF may be performed in response to the previous frame that is an error frame. When it is determined that the input signal is stationary, a length of an overlap duration of a smoothing window may be set to be longer, for example, to 6 ms.

If it is determined in operation 2513 that the input signal is not stationary and the previous frame is a burst error frame, then in operation 2515, error concealment processing on an NGF may be performed in response to the previous frame that is a burst error frame.

If it is determined in operation 2513 that the input signal is not stationary and the previous frame is a random error frame, then in operation 2516, general OLA processing may be performed.

Figure 26:
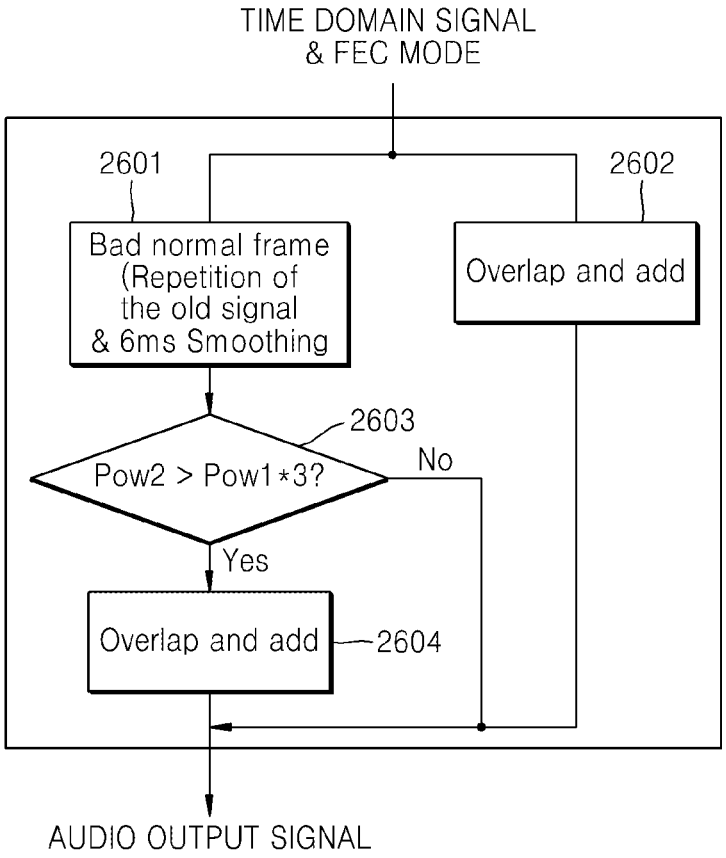
FIG. 26 is a block diagram illustrating an operation of a first error concealment unit in FIG. 23, according to an exemplary embodiment.

FIG. 26 is a flowchart illustrating an operation of the first time domain error concealment unit 2313 of FIG. 23, according to an exemplary embodiment.

Referring to FIG. 26, in operation 2601, when a current frame is an error frame, a signal of a previous frame may be repeated, and smoothing processing may be performed. According to an exemplary embodiment, a smoothing window having an overlap duration of 6 ms may be applied.

In operation 2603, energy Pow1 of a predetermined duration in an overlapping region may be compared with energy Pow2 of a predetermined duration in a non-overlapping region. In detail, when energy of the overlapping region decreases or highly increases after the error concealment processing, general OLA processing may be performed because the decrease in energy may occur when a phase is reversed in overlapping, and the increase in energy may occur when a phase is maintained in overlapping. When a signal is somewhat stationary, since the error concealment performance in operation 2601 is excellent, if an energy difference between the overlapping region and the non-overlapping region is large as a result of operation 2601, it indicates that a problem is generated due to a phase in overlapping.

If the energy difference between the overlapping region and the non-overlapping region is large as a result of the comparison in operation 2601, the result of operation 2601 is not selected, and general OLA processing may be performed in operation 2604.

If the energy difference between the overlapping region and the non-overlapping region is not large as a result of the comparison in operation 2601, the result of operation 2601 may be selected.

Figure 27:
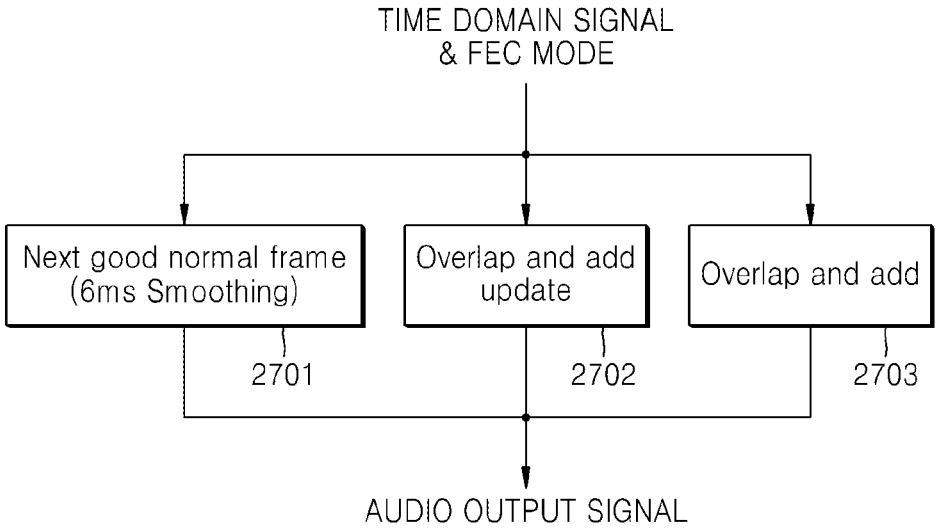
FIG. 27 is a block diagram illustrating an operation of a second error concealment unit in FIG. 23, according to an exemplary embodiment.

FIG. 27 is a flowchart illustrating an operation of the second time domain error concealment unit 2314 of FIG. 23, according to an exemplary embodiment. Operations 2701, 2702, and 2703 of FIG. 27 may correspond to operation 2514, operation 2515, and operation 2516 of FIG. 25, respectively.

Figure 28:
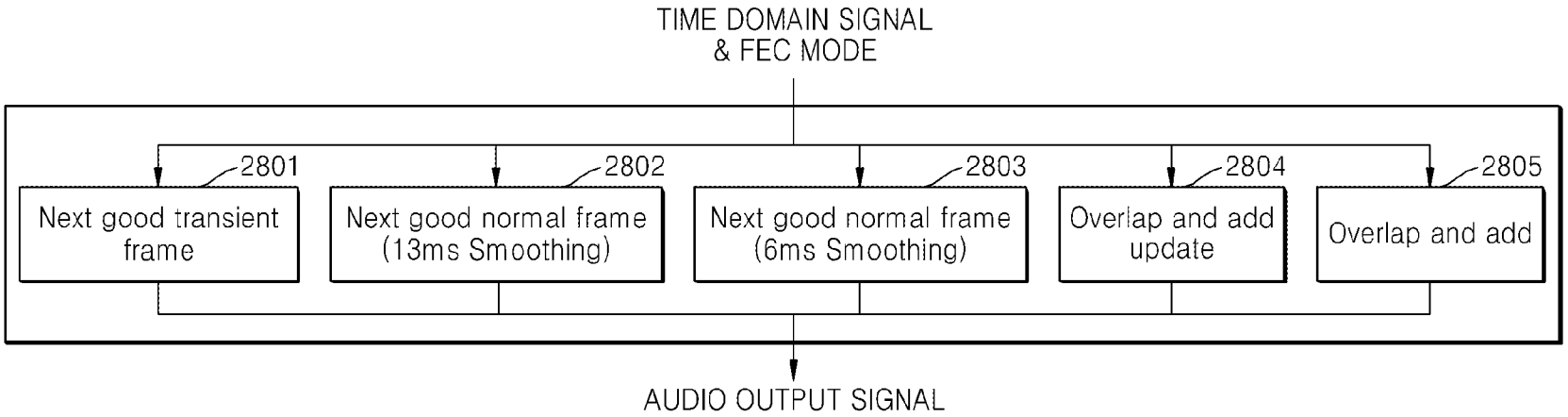
FIG. 28 is a block diagram illustrating an operation of a second error concealment unit in FIG. 23, according to another exemplary embodiment.

FIG. 28 is a flowchart illustrating an operation of the second time domain error concealment unit 2314 of FIG. 23, according to another exemplary embodiment. Compared with the embodiment of FIG. 27, the embodiment of FIG. 28 differs with respect to error concealment processing (operation 2801) when a current frame that is an NGF is a transient frame and error concealment processing (operations 2802 and 2803) using a smoothing window having a different length of an overlap duration when the current frame that is an NGF is not a transient frame. That is, the embodiment of FIG. 28 may be applied to a case where OLA processing on a transient frame is further included in addition to general OLA processing.

Figure 29:
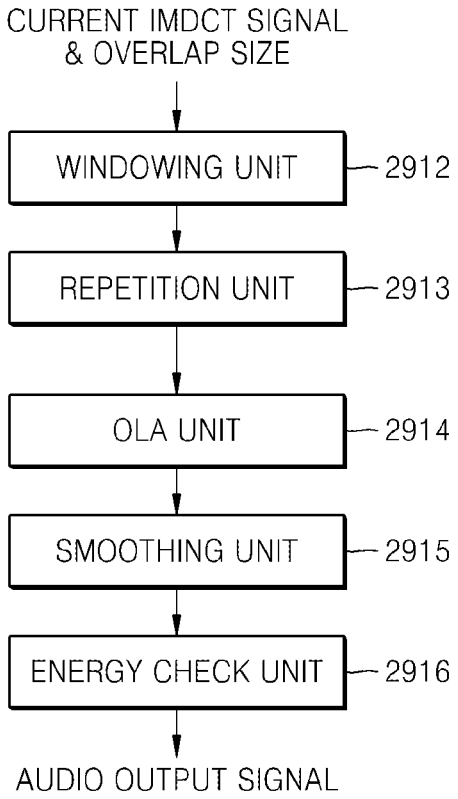
FIG. 29 is a block diagram for describing an error concealment method when a current frame is an error frame in FIG. 26, according to an exemplary embodiment.

FIG. 29 is a block diagram for describing an error concealment method when a current frame is an error frame in FIG. 26, according to an exemplary embodiment. Compared with the embodiment of FIG. 16, the embodiment of FIG. 29 differs in that a component corresponding to the overlap size selection unit (1615 of FIG. 16) is excluded while an energy checking unit 2916 is further included. That is, a smoothing unit 2915 may apply a predetermined smoothing window, and the energy checking unit 2916 may perform a function corresponding to operations 2603 and 2604 of FIG. 26.

Figure 30:
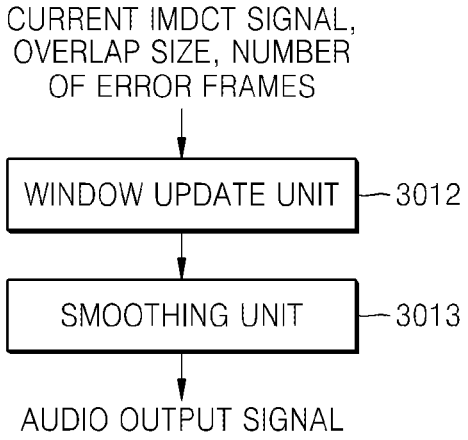
FIG. 30 is a block diagram for describing an error concealment method for a next good frame (NGF) that is a transient frame when a previous frame is an error frame in FIG. 28, according to an exemplary embodiment.

FIG. 30 is a block diagram for describing an error concealment method for an NGF that is a transient frame when a previous frame is an error frame in FIG. 28, according to an embodiment of the present invention. The embodiment of FIG. 30 may be preferably applied when a frame type of the previous frame is transient. That is, since the previous frame is transient, error concealment processing on the NGF may be performed by an error concealment method used in a past frame.

Referring to FIG. 30, a window update unit 3012 may update a length of an overlap duration of a window to be used for smoothing processing on a current frame by considering a window of the previous frame.

A smoothing unit 3013 may perform the smoothing processing by applying the smoothing window updated by the window update unit 3012 to the previous frame and the current frame that is an NGF.

Figure 31:
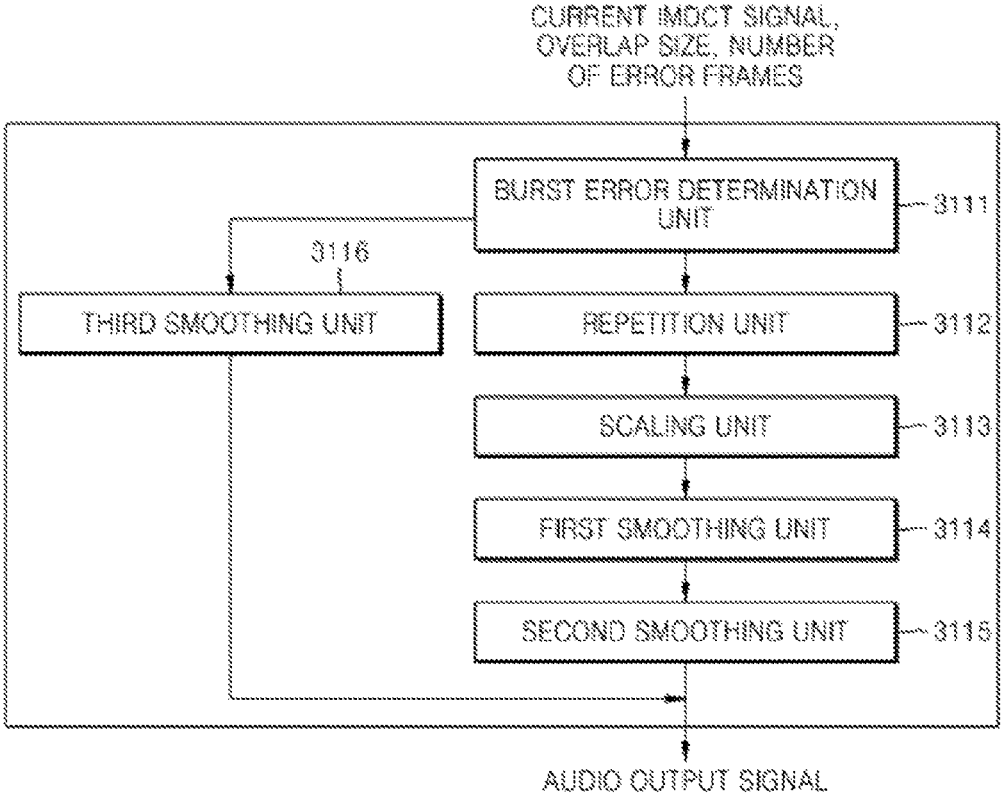
FIG. 31 is a block diagram for describing an error concealment method for an NGF that is not a transient frame when a previous frame is an error frame in FIG. 27 or 28, according to an exemplary embodiment.

FIG. 31 is a block diagram for describing an error concealment method for an NGF that is not a transient frame when a previous frame is an error frame in FIG. 27 or 28, according to an embodiment of the present invention, which corresponds to the embodiments of FIGS. 17 and 18. That is, according to the number of continuous error frames, error concealment processing corresponding to a random error frame may be performed as in FIG. 17, or error concealment processing corresponding to a burst error frame may be performed as in FIG. 18. However, compared with the embodiments of FIGS. 17 and 18, the embodiment of FIG. 31 differs in that an overlap size is set in advance.

Figure 32A:
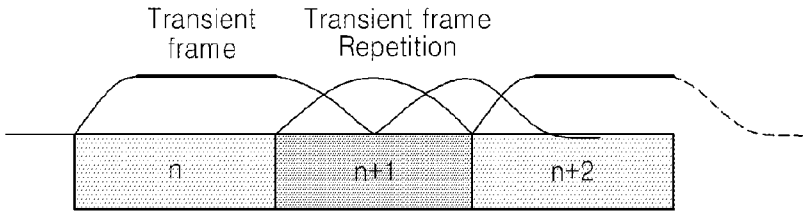
FIGS. 32A to 32D are diagrams for describing an example of OLA processing when a current frame is an error frame in FIG. 26.
Figure 32B:
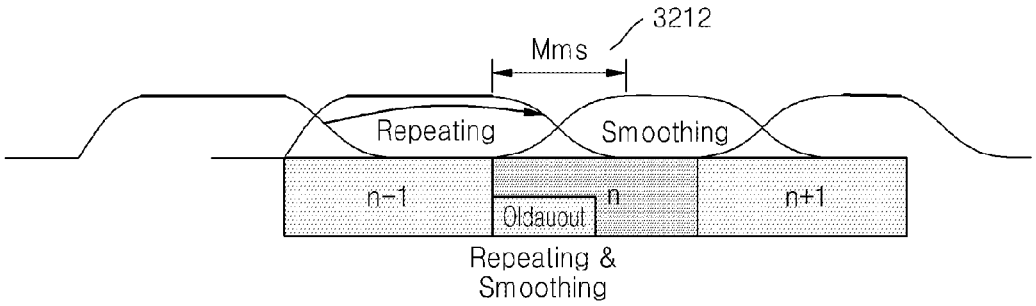
Figure 32C:
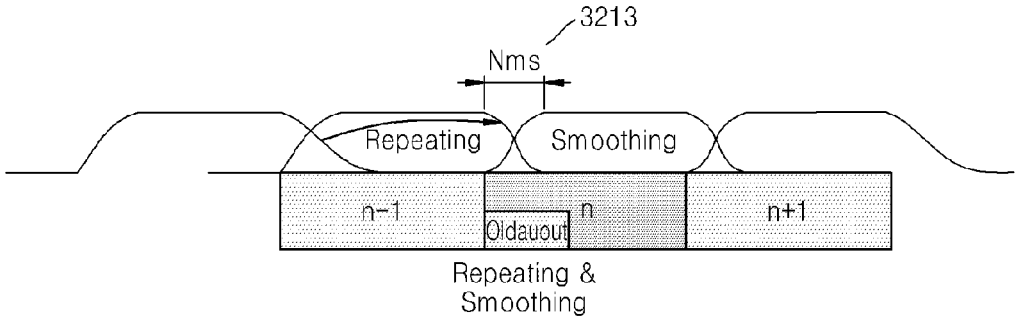
Figure 32D:
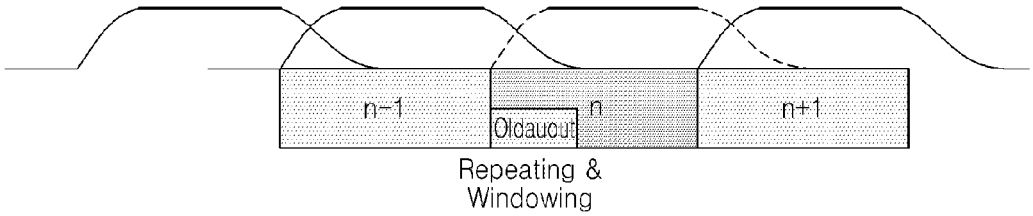

FIGS. 32A to 32D are diagrams for describing an example of OLA processing when a current frame is an error frame in FIG. 26. FIG. 32A is an example for a transient frame. FIG. 32B illustrates OLA processing on a very stationary frame, wherein a length of M is longer than N, and a length of an overlap duration in smoothing processing is long. FIG. 32C illustrates OLA processing on a less stationary frame than in the case of FIG. 32B, and FIG. 32D illustrates general OLA processing. The OLA processing may be independently used from OLA processing on an NGF.

Figure 33A:
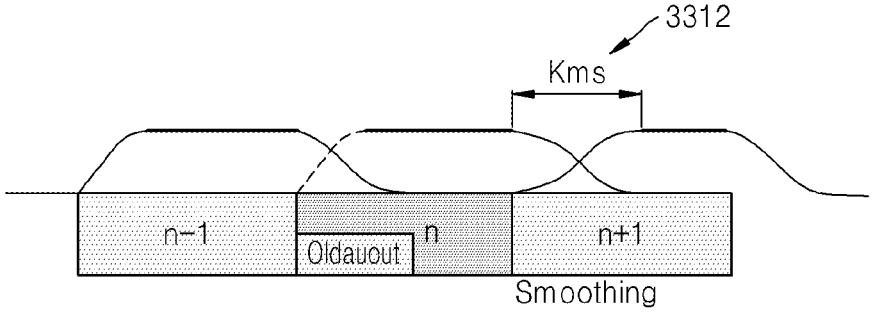
FIGS. 33A to 33C are diagrams for describing an example of OLA processing on a next frame when a previous frame is a random error frame in FIG. 27.
Figure 33B:
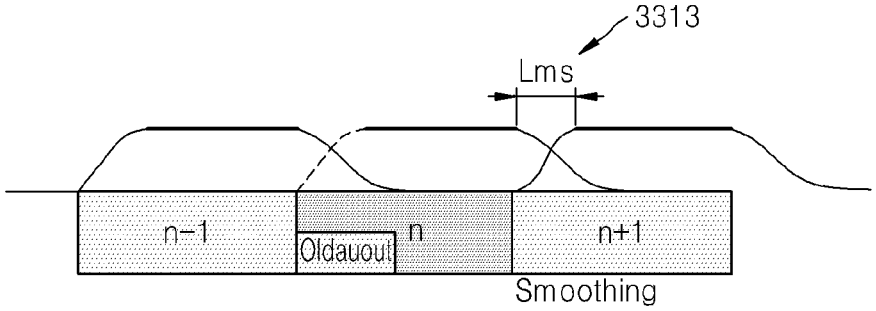
Figure 33C:
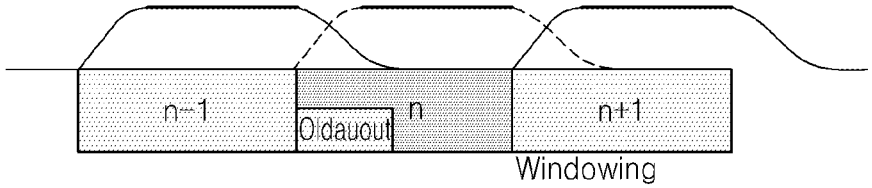

FIGS. 33A to 33C are diagrams for describing an example of OLA processing on an NGF when a previous frame is a random error frame in FIG. 27. FIG. 33A illustrates OLA processing on a very stationary frame, wherein a length of K is longer than L, and a length of an overlap duration in smoothing processing is long. FIG. 33B illustrates OLA processing on a less stationary frame than in the case of FIG. 33A, and FIG. 33C illustrates general OLA processing. The OLA processing may be independently used from OLA processing on an error frame. Thus, various combinations in OLA processing between an error frame and an NGF is possible.

Figure 34:
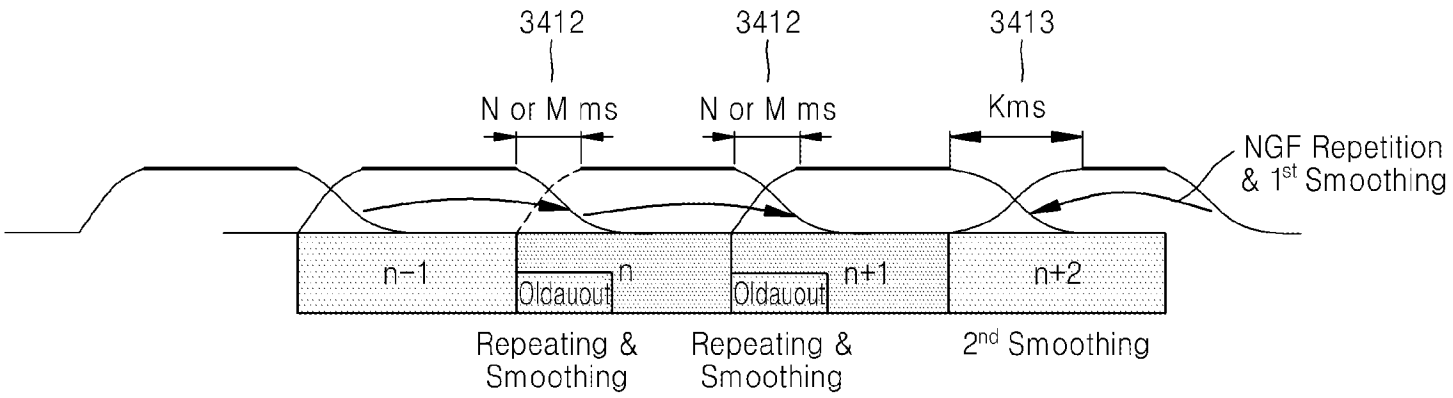
FIG. 34 is a diagram for describing an example of OLA processing on a next frame when a previous frame is a burst error frame in FIG. 27.

FIG. 34 is a diagram for describing an example of OLA processing on an NGF n+2 when a previous frame is a burst error frame in FIG. 27. Compared with FIGS. 18 and 20, FIG. 34 differs in that smoothing processing may be performed by adjusting a length 3412 or 3413 of an overlap duration of a smoothing window.

Figure 35:
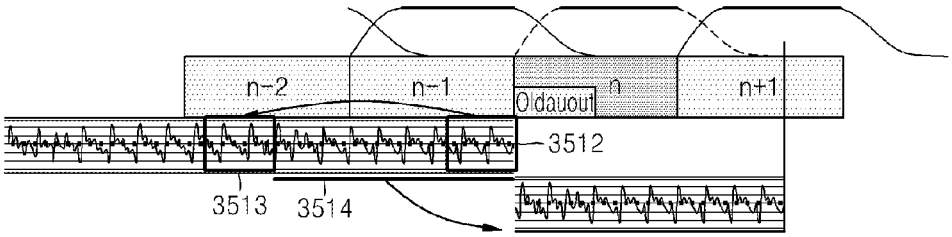
FIG. 35 is a diagram for describing the concept of a phase matching method, according to an exemplary embodiment.

FIG. 35 is a diagram for describing the concept of a phase matching method which is applied to an exemplary embodiment.

Referring to FIG. 35, when an error occurs in a frame n in a decoded audio signal, a matching segment 3513, which is most similar to a search segment 3512 adjacent to the frame n, may be searched for from a decoded signal in a previous frame n−1 from among N past normal frames stored in a buffer. At this time, a size of the search segment 3512 and a search range in the buffer may be determined according to a wavelength of a minimum frequency corresponding to a tonal component to be searched for. To minimize the complexity of a search, the size of the search segment 3512 is preferably small. For example, the size of the search segment 3512 may be set greater than a half of the wavelength of the minimum frequency and less than the wavelength of the minimum frequency. The search range in the buffer may be set equal to or greater than the wavelength of the minimum frequency to be searched. According to an embodiment of the present invention, the size of the search segment 3512 and the search range in the buffer may be set in advance according to an input band (NB, WB, SWB, or FB) based on the criterions described above.

In detail, the matching segment 3513 having the highest cross-correlation to the search segment 3512 may be searched for from among past decoded signals within the search range, location information corresponding to the matching segment 3513 may be obtained, and a predetermined duration 3514 starting from an end of the matching segment 3513 may be set by considering a window length, e.g., a length obtained by adding a frame length and a length of an overlap duration, and copied to the frame n in which an error has occurred.

Figure 36:
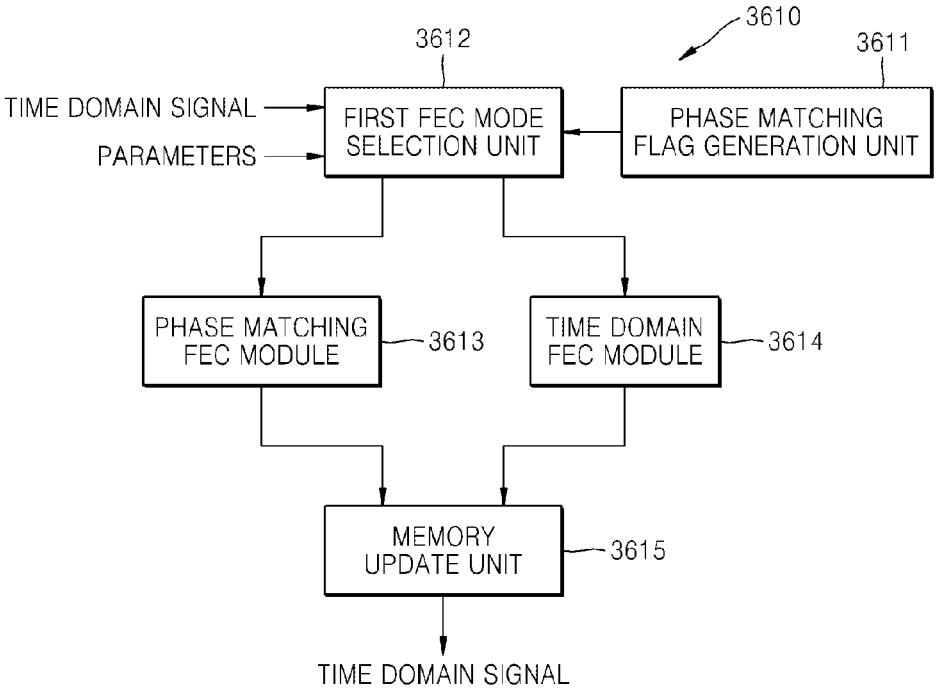
FIG. 36 is a block diagram of an error concealment apparatus according to an exemplary embodiment.

FIG. 36 is a block diagram of an error concealment apparatus 3610 according to an exemplary embodiment.

The error concealment apparatus 3610 shown in FIG. 36 may include a phase matching flag generation unit 3611, a first FEC mode selection unit 3612, a phase matching FEC module 3613, a time domain FEC module 3614, and a memory update unit 3615.

Referring to FIG. 36, the phase matching flag generation unit 3611 may generate a phase matching flag for determining whether phase matching error concealment processing is used in every normal frame when an error occurs in a next frame. To this end, energy and spectral coefficients of each sub-band may be used. The energy may be obtained from a Norm value, but is not limited thereto. In detail, when a sub-band having the maximum energy in a current frame that is a normal frame belongs to a predetermined low frequency band, and an in-frame or inter-frame energy change is not large, the phase matching flag may be set to 1. According to an exemplary embodiment, when a sub-band having the maximum energy in a current frame belongs to 75 Hz to 1000 Hz, and an index of the current frame is the same as an index of a previous frame with respect to a corresponding sub-band, phase matching error concealment processing may be applied to a next frame in which an error has occurred. According to another exemplary embodiment, when a sub-band having the maximum energy in a current frame belongs to 75 Hz to 1000 Hz, and a difference between an index of the current frame and an index of a previous frame with respect to a corresponding sub-band is 1 or less, phase matching error concealment processing may be applied to a next frame in which an error has occurred. According to another exemplary embodiment, when a sub-band having the maximum energy in a current frame belongs to 75 Hz to 1000 Hz, an index of the current frame is the same as an index of a previous frame with respect to a corresponding sub-band, the current frame is a stationary frame of which an energy change is small, and N past frames stored in a buffer are normal frames and are not transient frames, phase matching error concealment processing may be applied to a next frame in which an error has occurred. According to another exemplary embodiment, when a sub-band having the maximum energy in a current frame belongs to 75 Hz to 1000 Hz, a difference between an index of the current frame and an index of a previous frame with respect to a corresponding sub-band is 1 or less, the current frame is a stationary frame of which an energy change is small, and N past frames stored in the buffer are normal frames and are not transient frames, phase matching error concealment processing may be applied to a next frame in which an error has occurred. Whether the current frame is a stationary frame may be determined by comparing difference energy with a threshold used in the stationary frame detection process described above. In addition, it may be determined whether the latest three frames among a plurality of past frames stored in the buffer are normal frames, and it may be determined whether the latest two frames thereof are transient frames, but the present embodiment is not limited thereto.

Phase matching error concealment processing may be applied if an error occurs in a next frame when the phase matching flag generated by the phase matching flag generation unit 3611 is set to 1.

The first FEC mode selection unit 3612 may select one of a plurality of FEC modes by considering at least one of the phase matching flag and a state of at least one frame. The state of at least one frame may be obtained from a state of a current or by additionally considering a state of at least one previous frame. The phase matching flag may indicate a state of a PGF. The states of the previous frame and the current frame may include whether the previous frame or the current frame is an error frame, whether the current frame is a random error frame or a burst error frame, or whether phase matching error concealment processing on a previous error frame has been performed. According to an exemplary embodiment, the plurality of FEC modes may include a first main FEC mode using phase matching error concealment processing and a second main FEC mode using time domain error concealment processing. The first main FEC mode may include a first sub FEC mode for a current frame of which the phase matching flag is set to 1 and which is a random error frame, a second sub FEC mode for a current frame that is an NGF when a previous frame is an error frame and phase matching error concealment processing on the previous frame has been performed, and a third sub FEC mode for a current frame forming a burst error frame when phase matching error concealment processing on the previous frame has been performed. According to an exemplary embodiment, the second main FEC mode may include a fourth sub FEC mode for a current frame of which the phase matching flag is set to 0 and which is an error frame and a fifth sub FEC mode for a current frame of which the phase matching flag is set to 0 and which is an NGF of a previous error frame. According to an exemplary embodiment, the fourth or fifth sub FEC mode may be selected in the same method as described with respect to FIG. 23, and the same error concealment processing may be performed in correspondence with the selected FEC mode.

The phase matching FEC module 3613 may operate when the FEC mode selected by the first FEC mode selection unit 3612 is the first main FEC mode and generate an error-concealed time domain signal by performing phase matching error concealment processing corresponding to each of the first to third sub FEC modes. Herein, for convenience of description, it is shown that the error-concealed time domain signal is output via the memory update unit 3615.

The time domain FEC module 3614 may operate when the FEC mode selected by the first FEC mode selection unit 3612 is the second main FEC mode and generate an error-concealed time domain signal by performing phase matching error concealment processing corresponding to each of the fourth and fifth sub FEC modes. Likewise, for convenience of description, it is shown that the error-concealed time domain signal is output via the memory update unit 3615.

The memory update unit 3615 may receive a result of the error concealment in the phase matching FEC module 3613 or the time domain FEC module 3614 and update a plurality of parameters for error concealment processing on a next frame. According to an exemplary embodiment, functions of the memory update unit 3615 may be included in the phase matching FEC module 3613 and the time domain FEC module 3614.

As described above, by repeating a phase-matching signal in the time domain instead of repeating spectral coefficients obtained in the frequency domain for an error frame, when a window having an overlap duration of a length less than 50% is used, noise, which may be generated in the overlap duration in a low frequency band, may be efficiently restrained.

Figure 37:
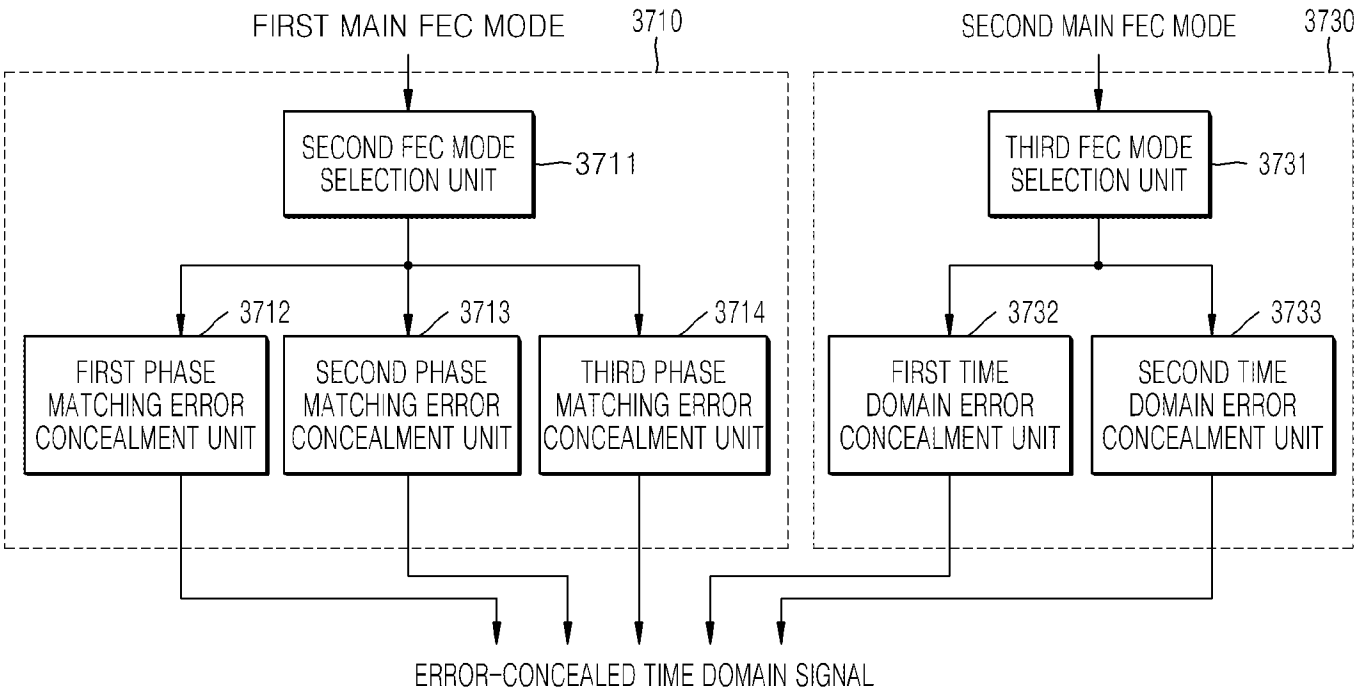
FIG. 37 is a block diagram of a phase matching FEC module or a time domain FEC module in FIG. 36, according to an exemplary embodiment.

FIG. 37 is a block diagram of the phase matching FEC module 3613 or the time domain FEC module 3614 of FIG. 36, according to an exemplary embodiment.

The phase matching FEC module 3710 shown in FIG. 37 may include a second FEC mode selection unit 3711 and first to third phase matching error concealment units 3712, 3713, and 3714, and the time domain FEC module 3730 shown in FIG. 37 may include a third FEC mode selection unit 3731 and first and second time domain error concealment units 3732 and 3733. According to an exemplary embodiment, the second FEC mode selection unit 3711 and the third FEC mode selection unit 3731 may be included in the first FEC mode selection unit 3612 of FIG. 36.

Referring to FIG. 37, the first phase matching error concealment unit 3712 may perform phase matching error concealment processing on a current frame that is a random error frame when a PGF has the maximum energy in a predetermined low frequency band and a change in energy is less than a predetermined threshold. According to an embodiment of the present invention, even though the above condition is satisfied, a correlation scale accA is obtained, and phase matching error concealment processing or general OLA processing may be performed according to whether the correlation scale accA is within a predetermined range. That is, whether phase matching error concealment processing is performed is preferably determined by considering a correlation between segments existing in a search range and a cross-correlation between a search segment and the segments existing in the search range. This will now be described in more detail.

The correlation scale accA may be obtained by Equation 4.

$$accA = \min\left(\frac{R_{xy}[d]}{R_{yy}[d]}\right), \quad d = 0, \ldots, D \tag{4}$$

In Equation 4, d denotes the number of segments existing in a search range, $R_{xy}$ denotes a cross-correlation used to search for the matching segment 3513 having the same length as the search segment (x signal) 3512 with respect to the N past normal frames (y signal) stored in the buffer with reference to FIG. 35, and $R_{yy}$ denotes a correlation between segments existing in the N past normal frames (y signal) stored in the buffer.

Next, it may be determined whether the correlation scale accA is within the predetermined range, and if the correlation scale accA is within the predetermined range, phase matching error concealment processing on a current frame that is an error frame, otherwise, general OLA processing on the current frame may be performed. According to an exemplary embodiment, if the correlation scale accA is less than 0.5 or greater than 1.5, general OLA processing may be performed, otherwise, phase matching error concealment processing may be performed. Herein, the upper limit value and the lower limit value are only illustrative, and may be set in advance as optimal values through experiments or simulations.

The second phase matching error concealment unit 3713 may perform phase matching error concealment processing on a current frame that is a PGF when a previous frame is an error frame and phase matching error concealment processing on the previous frame has been performed.

The third phase matching error concealment unit 3714 may perform phase matching error concealment processing on a current frame forming a burst error frame when a previous frame is an error frame and phase matching error concealment processing on the previous frame has been performed.

The first time domain error concealment unit 3732 may perform time domain error concealment processing on a current frame that is an error frame when a PGF does not have the maximum energy in a predetermined low frequency band.

The second time domain error concealment unit 3733 may perform time domain error concealment processing on a current frame that is an NGF of a previous error frame when a PGF does not have the maximum energy in the predetermined low frequency band.

Figure 38:
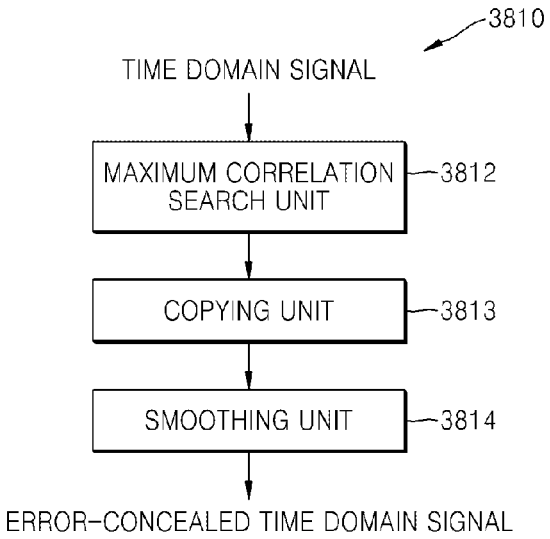
FIG. 38 is a block diagram of a first phase matching error concealment unit or a second phase matching error concealment unit in FIG. 37, according to an exemplary embodiment.

FIG. 38 is a block diagram of the first or second phase matching error concealment unit 3712 or 3713 of FIG. 37, according to an exemplary embodiment.

The phase matching error concealment unit 3810 shown in FIG. 38 may include a maximum correlation search unit 3812, a copying unit 3813, and a smoothing unit 3814. The smoothing unit 3814 may be optionally included.

Referring to FIG. 38, the maximum correlation search unit 3812 may search for a matching segment, which has the maximum correlation to, i.e., is most similar to, a search segment adjacent to a current frame, from a decoded signal in a PGF from among N past normal frames stored in a buffer. A location index of the matching segment obtained as a result of the search may be provided to the copying unit 3813. The maximum correlation search unit 3812 may operate in the same way for a current frame that is a random error frame or a current frame that is a normal frame when a previous frame is a random error frame and phase matching error concealment processing on the previous frame has been performed. When the current frame is an error frame, frequency domain error concealment processing may be preferably performed in advance. According to an exemplary embodiment, the maximum correlation search unit 3812 may obtain a correlation scale for the current frame that is an error frame for which it has been determined that phase matching error concealment processing is to be performed and determine again whether the phase matching error concealment processing is suitable.

The copying unit 3813 may copy a predetermined duration starting from an end of the matching segment to the current frame that is an error frame by referring to the location index of the matching segment. In addition, the copying unit 3813 may copy the predetermined duration starting from the end of the matching segment to the current frame that is a normal frame by referring to the location index of the matching segment when the previous frame is a random error frame and phase matching error concealment processing on the previous frame has been performed. At this time, a duration corresponding to a window length may be copied to the current frame. According to an exemplary embodiment, when a copyable duration starting from the end of the matching segment is shorter than the window length, the copyable duration starting from the end of the matching segment may be repeatedly copied to the current frame.

The smoothing unit 3814 may generate a time domain signal on the error-concealed current frame by performing smoothing processing through OLA to minimize the discontinuity between the current frame and adjacent frames. An operation of the smoothing unit 3814 will be described in detail with reference to FIGS. 39 and 40.

Figure 39:
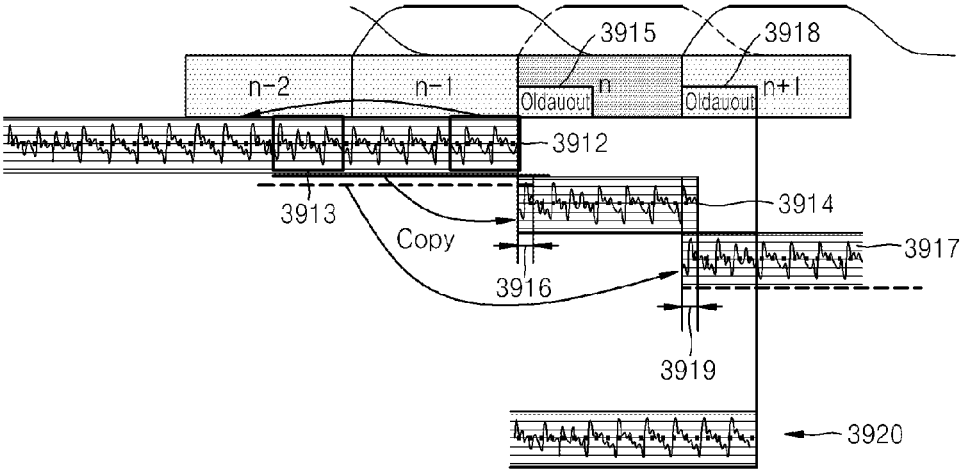
FIG. 39 is a diagram for describing an operation of a smoothing unit in FIG. 38, according to an exemplary embodiment.

FIG. 39 is a diagram for describing an operation of the smoothing unit 3814 of FIG. 38, according to an exemplary embodiment.

Referring to FIG. 39, a matching segment 3913, which is most similar to a search segment 3912 adjacent to a current frame n that is an error frame, may be searched for from a decoded signal in a previous frame n−1 from among N past normal frames stored in a buffer. Next, a predetermined duration starting from an end of the matching segment 3913 may be copied to the current frame n in which an error has occurred, by considering a window length. When the copy process is completed, overlapping on a copied signal 3914 and an Oldauout signal 3915 stored in the previous frame n−1 for overlapping may be performed at a beginning part of the current frame n by a first overlap duration 3916. A length of the first overlap duration 3916 may be shorter than a length used in general OLA processing since phases of signals match each other. For example, if 6 ms is used in general OLA processing, the first overlap duration 3916 may use 1 ms, but is not limited thereto. When a copyable duration starting from an end of the matching segment 3913 is shorter than the window length, the copyable duration starting from the end of the matching segment 3913 may overlap partially and be repeatedly copied to the current frame n. According to an exemplary embodiment, the overlap duration may be the same as the first overlap duration 3916. In this case, overlapping on an overlapping part in two copied signals 3914 and 3917 and an Oldauout signal 3918 stored in the current frame n for overlapping may be performed at a beginning part of a next frame n+1 by a second overlap duration 3919. A length of the second overlap duration 3919 may be shorter than a length used in general OLA processing since phases of signals match each other. For example, the length of the second overlap duration 3919 may be the same as the length of the first overlap duration 3916. That is, when the copyable duration starting from the end of the matching segment 3913 is equal to or longer than the window length, only the overlapping with respect to the first overlap duration 3916 may be performed. As described above, by performing the overlapping on the copied signal 3914 and the Oldauout signal 3915 stored in the previous frame n−1 for overlapping, the discontinuity with the previous frame n−1 at the beginning part of the current frame n may be minimized. As a result, a signal 3920 which corresponds to the window length and for which smoothing processing between the current frame n and the previous frame n−1 has been performed and an error has been concealed may be generated.

Figure 40:
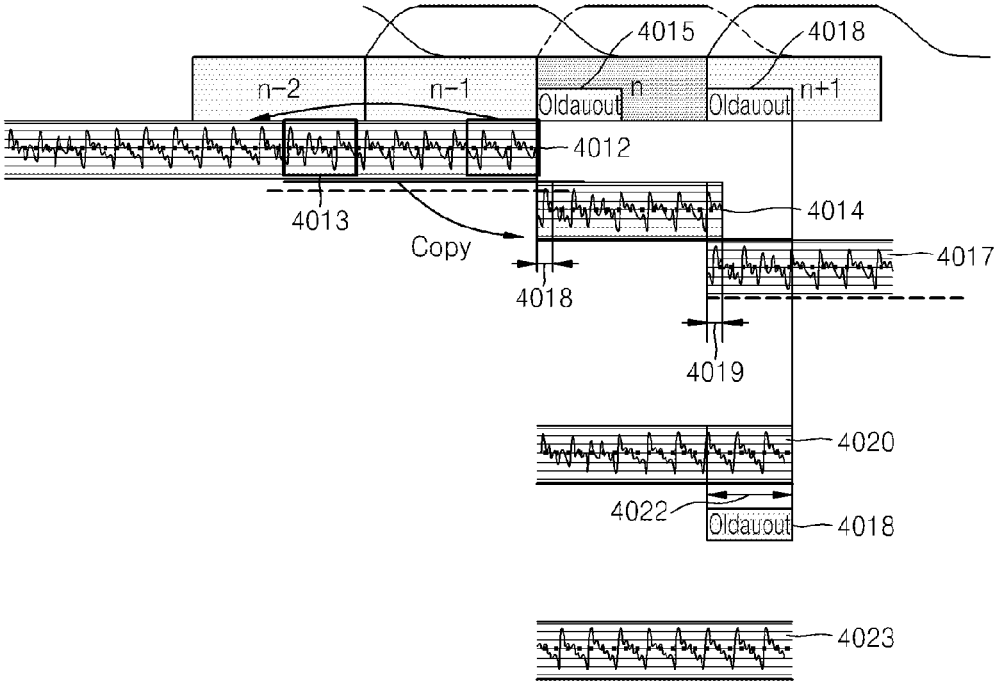
FIG. 40 is a diagram for describing an operation of the smoothing unit in FIG. 38, according to another exemplary embodiment.

FIG. 40 is a diagram for describing an operation of the smoothing unit 3814 of FIG. 38, according to another exemplary embodiment.

Referring to FIG. 40, a matching segment 4013, which is most similar to a search segment 4012 adjacent to a current frame n that is an error frame, may be searched for from a decoded signal in a previous frame n−1 from among N past normal frames stored in a buffer. Next, a predetermined duration starting from an end of the matching segment 4013 may be copied to the current frame n in which an error has occurred, by considering a window length. When the copy process is completed, overlapping on a copied signal 4014 and an Oldauout signal 4015 stored in the previous frame n−1 for overlapping may be performed at a beginning part of the current frame n by a first overlap duration 4016. A length of the first overlap duration 4016 may be shorter than a length used in general OLA processing since phases of signals match each other. For example, if 6 ms is used in general OLA processing, the first overlap duration 4016 may use 1 ms, but is not limited thereto. When a copyable duration starting from an end of the matching segment 4013 is shorter than the window length, the copyable duration starting from the end of the matching segment 4013 may overlap partially and be repeatedly copied to the current frame n. In this case, overlapping on an overlapping part 4019 in two copied signals 4014 and 4017 may be performed. A length of the overlapping part 4019 may be preferably the same as the length of the first overlap duration 4016. That is, when the copyable duration starting from the end of the matching segment 4013 is equal to or longer than the window length, only the overlapping with respect to the first overlap duration 4016 may be performed. As described above, by performing the overlapping on the copied signal 4014 and the Oldauout signal 4015 stored in the previous frame n−1 for overlapping, the discontinuity with the previous frame n−1 at the beginning part of the current frame n may be minimized. As a result, a first signal 4020 which corresponds to the window length and for which smoothing processing between the current frame n and the previous frame n−1 has been performed and an error has been concealed may be generated. Next, by performing, in an overlap duration 4022, overlapping on a signal corresponding the overlap duration 4022 and an Oldauout signal 4018 stored in the current frame n for overlapping, a second signal 4023 for which the discontinuity between the current frame n that is an error frame and a next frame n+1 in the overlap duration 4022 is minimized may be generated.

Accordingly, when a main frequency, e.g., a fundamental frequency, of a signal varies in every frame, or when the signal rapidly varies, even though phase mismatching occurs at an end part of a copied signal, i.e., in an overlap duration with the next frame n+1, the discontinuity between the current frame n and the next frame n+1 may be minimized by performing smoothing processing.

A part corresponding to each future region of the first signal 4020 for which smoothing processing between the current frame n and the previous frame n−1 has been performed and the error has been concealed and the second signal 4023 for which the discontinuity in the overlap duration 4022 between the current frame n and the next frame n+1 has been minimized, i.e., a part overlapping the next frame n+1, may be stored in a memory. In an NGF, one of parts stored in the memory may be selected according to a characteristic of a signal and used for overlapping as an Oldauout signal in actual decoding.

Phase matching on an NGF may be the same as processing on an NGF in the time domain except for a part of selecting an Oldauout signal. According to an embodiment of the present invention, the two Oldauout signals 4015 and 4018 of a phase matching block, which are generated in FIG. 40, may be determined as below:

```
if((mean_en_high>2.f)||(mean_en_high<0.5f))
{
    oldout_pha_idx = 1;
}
else
{
    oldout_pha_idx = 0;
}
```

where mean_en_high denotes information indicating a change level of a signal for each frame and may be calculated in advance by a memory update unit for a normal frame. According to an embodiment of the present invention, mean_en_high may indicate a mean value of values obtained for all the bands after obtaining a ratio of an energy average of two previous frames to energy of a current frame for each band at the time of the calculation. When a value of mean_en_high is close to 1, this may indicate that a change between the energy average of the two previous frames and the energy of the current frame, and when the value of mean_en_high is less than 0.5 or greater than 2, this may indicate that a change in energy is very severe.

When the change in energy is very severe, oldout_pha_idx is set to 1, and this case indicates that the second signal 4023 is used. When the change in energy is not severe, oldout_pha_idx is set to 0, and this case indicates that the first signal 4020 is used.

Next, a case of phase matching for a burst error does not need an optimal segment search process, and for the other parts except for the search process, a concealment process may be performed according to the same sequences as described with reference to FIG. 39 or 40.

Figure 41:
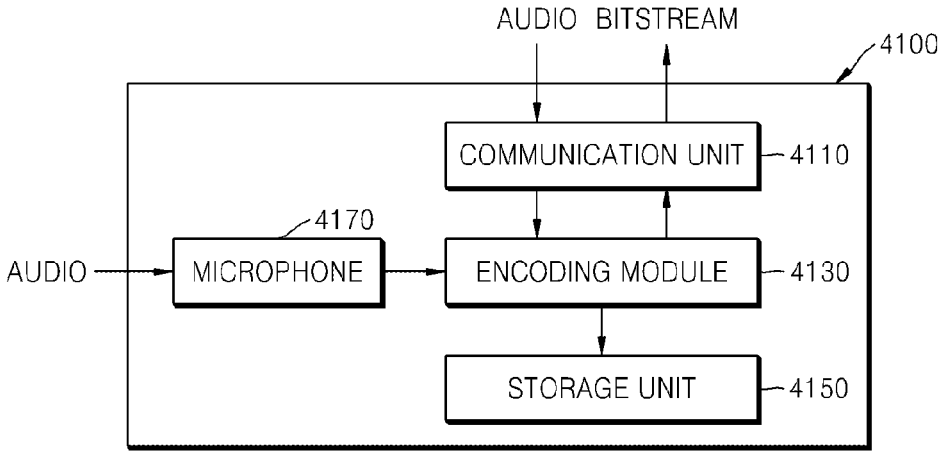
FIG. 41 is a block diagram of a multimedia device including an encoding module, according to an exemplary embodiment.

FIG. 41 is a block diagram of a multimedia device including an encoding module, according to an exemplary embodiment.

Referring to FIG. 41, the multimedia device 4100 may include a communication unit 4110 and the encoding module 4130. In addition, the multimedia device 4100 may further include a storage unit 4150 for storing an audio bitstream obtained as a result of encoding according to the usage of the audio bitstream. Moreover, the multimedia device 4100 may further include a microphone 4170. That is, the storage unit 4150 and the microphone 4170 may be optionally included. The multimedia device 4100 may further include an arbitrary decoding module (not shown), e.g., a decoding module for performing a general decoding function or a decoding module according to an exemplary embodiment. The encoding module 4130 may be implemented by at least one processor, e.g., a central processing unit (not shown) by being integrated with other components (not shown) included in the multimedia device 4100 as one body.

The communication unit 4110 may receive at least one of an audio signal or an encoded bitstream provided from the outside or transmit at least one of a restored audio signal or an encoded bitstream obtained as a result of encoding by the encoding module 4130.

The communication unit 4110 is configured to transmit and receive data to and from an external multimedia device through a wireless network, such as wireless Internet, wireless intranet, a wireless telephone network, a wireless Local Area Network (LAN), Wi-Fi, Wi-Fi Direct (WFD), third generation (3G), fourth generation (4G), Bluetooth, Infrared Data Association (IrDA), Radio Frequency Identification (RFID), Ultra WideBand (UWB), Zigbee, or Near Field Communication (NFC), or a wired network, such as a wired telephone network or wired Internet.

According to an exemplary embodiment, the encoding module 4130 may set a hangover flag for a next frame in consideration of whether a duration in which a transient is detected in a current frame belongs to an overlap duration, in a time domain signal, which is provided through the communication unit 4110 or the microphone 4170.

The storage unit 4150 may store the encoded bitstream generated by the encoding module 4130. In addition, the storage unit 4150 may store various programs required to operate the multimedia device 4100.

The microphone 4170 may provide an audio signal from a user or the outside to the encoding module 4130.

Figure 42:
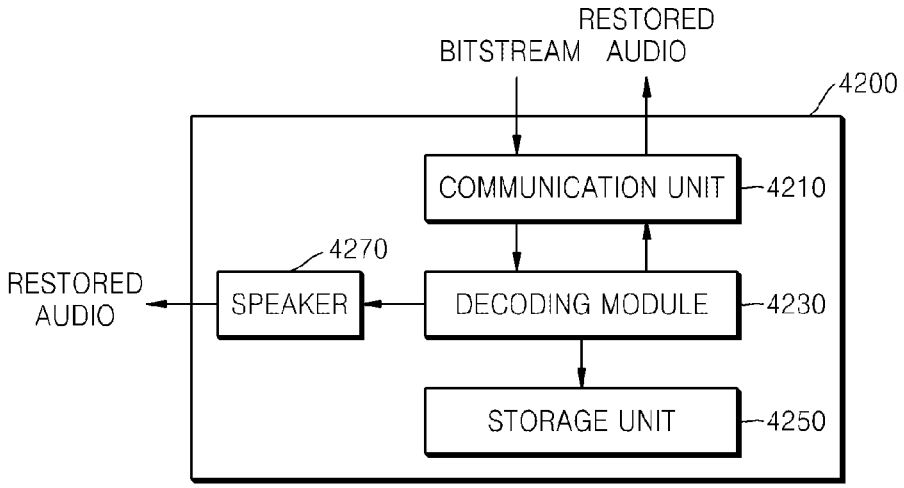
FIG. 42 is a block diagram of a multimedia device including a decoding module, according to an exemplary embodiment.

FIG. 42 is a block diagram of a multimedia device including a decoding module, according to an exemplary embodiment.

The multimedia device 4200 of FIG. 42 may include a communication unit 4210 and the decoding module 4230. In addition, according to the use of a restored audio signal obtained as a decoding result, the multimedia device 4200 of FIG. 42 may further include a storage unit 4250 for storing the restored audio signal. In addition, the multimedia device 4200 of FIG. 42 may further include a speaker 4270. That is, the storage unit 4250 and the speaker 4270 are optional. The multimedia device 4200 of FIG. 42 may further include an encoding module (not shown), e.g., an encoding module for performing a general encoding function or an encoding module according to an exemplary embodiment. The decoding module 4230 may be integrated with other components (not shown) included in the multimedia device 4200 and implemented by at least one processor, e.g., a central processing unit (CPU).

Referring to FIG. 42, the communication unit 4210 may receive at least one of an audio signal or an encoded bitstream provided from the outside or may transmit at least one of a restored audio signal obtained as a result of decoding of the decoding module 4230 or an audio bitstream obtained as a result of encoding. The communication unit 4210 may be implemented substantially and similarly to the communication unit 4110 of FIG. 41.

According to an exemplary embodiment, the decoding module 4230 may receive a bitstream provided through the communication unit 4210, perform error concealment processing in a frequency domain when a current frame is an error frame, decode spectral coefficients when the current frame is a normal frame, perform time-frequency inverse transform processing on the current frame that is an error frame or a normal frame, and select an FEC mode from among a first main mode using phase matching and a second main mode using simple repetition, based on at least one of a state of a frame and a phase matching flag, with regard to a time domain signal generated after time-frequency inverse transform processing and perform corresponding time domain error concealment processing on the current frame based on the selected FEC mode, wherein the current frame is an error frame or the current frame is a normal frame when the previous frame is an error frame.

The storage unit 4250 may store the restored audio signal generated by the decoding module 4230. In addition, the storage unit 4250 may store various programs required to operate the multimedia device 4200.

The speaker 4270 may output the restored audio signal generated by the decoding module 4230 to the outside.

Figure 43:
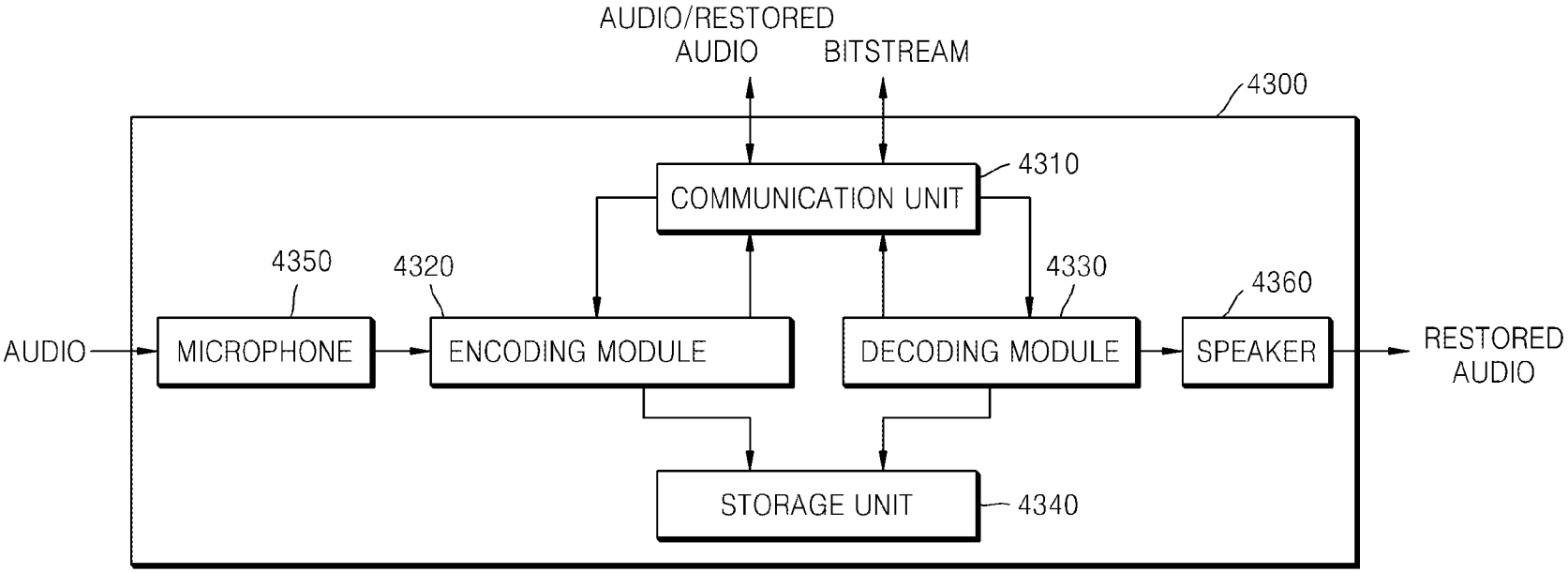
FIG. 43 is a block diagram of a multimedia device including an encoding module and a decoding module, according to an exemplary embodiment.

FIG. 43 is a block diagram of a multimedia device including an encoding module and a decoding module, according to an exemplary embodiment.

The multimedia device 4300 shown in FIG. 43 may include a communication unit 4310, an encoding module 4320, and a decoding module 4330. In addition, the multimedia device 4300 may further include a storage unit 4340 for storing an audio bitstream obtained as a result of encoding or a restored audio signal obtained as a result of decoding according to the usage of the audio bitstream or the restored audio signal. In addition, the multimedia device 4300 may further include a microphone 4350 and/or a speaker 4360. The encoding module 4320 and the decoding module 4330 may be implemented by at least one processor, e.g., a central processing unit (CPU) (not shown) by being integrated with other components (not shown) included in the multimedia device 4300 as one body.

Since the components of the multimedia device 4300 shown in FIG. 43 correspond to the components of the multimedia device 4100 shown in FIG. 41 or the components of the multimedia device 4200 shown in FIG. 42, a detailed description thereof is omitted.

Each of the multimedia devices 4100, 4200, and 4300 shown in FIGS. 41, 42, and 43 may include a voice communication only terminal, such as a telephone or a mobile phone, a broadcasting or music only device, such as a TV or an MP3 player, or a hybrid terminal device of a voice communication only terminal and a broadcasting or music only device but are not limited thereto. In addition, each of the multimedia devices 4100, 4200, and 4300 may be used as a client, a server, or a transducer displaced between a client and a server.

When the multimedia device 4100, 4200, or 4300 is, for example, a mobile phone, although not shown, the multimedia device 4100, 4200, or 4300 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 4100, 4200, or 4300 is, for example, a TV, although not shown, the multimedia device 4100, 4200, or 4300 may further include a user input unit, such as a keypad, a display unit for displaying received broadcasting information, and a processor for controlling all functions of the TV. In addition, the TV may further include at least one component for performing a function of the TV.

According to exemplary embodiments, in audio encoding and decoding using time-frequency transform processing, when an error occurs in partial frames in a decoded audio signal, by performing smoothing processing in an optimal method according to a signal characteristic in the time domain, a rapid signal fluctuation due to an error frame in the decoded audio signal may be smoothed with low complexity without an additional delay.

In particular, an error frame that is a transient frame or an error frame constituting a burst error may be more accurately reconstructed, and as a result, influence affected to a normal frame next to the error frame may be minimized.

In addition, by copying a predetermined sized segment obtained using phase matching from a plurality of previous frames stored in a buffer to a current frame that is an error frame and performing smoothing processing between adjacent frames, the improvement of reconstructed sound quality for a low frequency band may be additionally expected.

The methods according to the embodiments can be written as computer-executable programs and can be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While the exemplary embodiments have been particularly shown and described, it will be understood by those of ordinary skill in the art that various changes in form and details may be made therein without departing from the spirit and scope of the inventive concept as defined by the appended claims.

What is claimed is:

1. A frame error concealment apparatus comprising:

at least one processor configured to:

when a frame is classified as a current error frame or a next good frame after an error frame, select one mode from among a plurality of modes including a first mode using phase matching and a second mode using repetition and smoothing, based on a plurality of parameters including stationarity of the frame; and perform a corresponding error concealment processing on the frame based on the selected mode.

2. The apparatus of claim 1, wherein the plurality of parameters include a first parameter, which is generated to determine whether the first mode is used in a next error frame for a good frame, and a second parameter, which is generated according to whether the first mode is used in a previous frame of the frame.

3. The apparatus of claim 2, wherein the first parameter is generated using energy and spectral coefficients of subbands in the good frame.

4. The apparatus of claim 1, wherein when the first mode is selected, the performing a corresponding error concealment processing is based on whether the frame is a single error frame, a burst error frame or the next good frame.

5. The apparatus of claim 1, wherein when the second mode is selected, the performing a corresponding error concealment processing is based on whether the frame is a single error frame, a burst error frame or the next good frame.

6. The apparatus of claim 1, wherein when the first mode is selected, the performing a corresponding error concealment processing is based on copying a phase-matched signal obtained from a plurality of previous good frames.

7. The apparatus of claim 1, wherein when the first mode is selected and the frame is the current error frame, the performing a corresponding error concealment processing is based on copying a phase-matched signal obtained from a plurality of previous good frames, to the frame and smoothing processing between the frame and adjacent frames.

8. The apparatus of claim 7, wherein the smoothing processing includes processing on a beginning part of the current error frame.

9. The apparatus of claim 7, wherein the smoothing processing includes processing on a beginning part and an end part of the current error frame.

10. The apparatus of claim 1, wherein the processor is configured further to perform a frequency domain error concealment processing on the frame when the frame is the current error frame.

* * * * *